US010119250B2

(12) United States Patent
Iwamura et al.

(10) Patent No.: US 10,119,250 B2
(45) Date of Patent: Nov. 6, 2018

(54) WORK MACHINE CONTROL SYSTEM, WORK MACHINE, AND WORK MACHINE CONTROL METHOD

(71) Applicant: Komatsu Ltd., Tokyo (JP)

(72) Inventors: Tsutomu Iwamura, Yokohama (JP); Yoshiro Iwasaki, Naka-gun (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 15/507,445

(22) PCT Filed: May 31, 2016

(86) PCT No.: PCT/JP2016/066081

§ 371 (c)(1),
(2) Date: Feb. 28, 2017

(87) PCT Pub. No.: WO2016/186220

PCT Pub. Date: Nov. 24, 2016

(65) Prior Publication Data

US 2017/0342687 A1 Nov. 30, 2017

(51) Int. Cl.

| | |
|---|---|
| ***E02F 9/26*** | (2006.01) |
| ***E02F 3/32*** | (2006.01) |
| ***E02F 3/43*** | (2006.01) |
| ***E02F 9/20*** | (2006.01) |

(52) U.S. Cl.

CPC ..... *E02F 9/262* (2013.01); *E02F 3/32* (2013.01); *E02F 3/435* (2013.01); *E02F 9/2033* (2013.01)

(58) Field of Classification Search

CPC ... E02F 9/262; E02F 3/32; E02F 3/435; E02F 9/2033

See application file for complete search history.

(56) References Cited

U.S. PATENT DOCUMENTS 5,356,259 A * 10/1994 Hanamoto ..... E02F 3/437 37/348
5,404,661 A * 4/1995 Sahm ..... E02F 3/427 37/347
9,458,597 B2 10/2016 Ikegami et al.
9,650,755 B2 5/2017 Nomura et al.
(Continued)

FOREIGN PATENT DOCUMENTS

JP 06-193090 A 7/1994
JP 2014-074319 A 4/2014
(Continued)

OTHER PUBLICATIONS

International Search Report dated Aug. 30, 2016, issued for PCT/JP2016/066081.

*Primary Examiner* — Richard M Camby
(74) *Attorney, Agent, or Firm* — Locke Lord LLP

(57) ABSTRACT

A work machine control system that controls a work machine including a member that rotates about a shaft line includes a target construction shape generation unit that generates a target construction shape indicating a target shape of a construction target of the work machine; and a determination unit that outputs first information when the member is present on an air side which is a side on which the work machine is present in relation to the target construction shape and outputs second information when the member is not present on the air side.

8 Claims, 26 Drawing Sheets

(56) References Cited

U.S. PATENT DOCUMENTS

| | | | |
|---|---|---|---|
| 2015/0345114 | A1 | 12/2015 | Nomura et al. |
| 2016/0138240 | A1 | 5/2016 | Ikegami et al. |
| 2016/0289928 | A1 | 10/2016 | Kitajima |

FOREIGN PATENT DOCUMENTS

| | | | |
|---|---|---|---|
| KR | 10-2016-0033649 | A | 3/2016 |
| WO | 2015/186179 | A1 | 12/2015 |

* cited by examiner

WORK MACHINE CONTROL SYSTEM, WORK MACHINE, AND WORK MACHINE CONTROL METHOD

FIELD

The present invention relates to a work machine control system, a work machine, and a work machine control method.

BACKGROUND

A work machine including a working device having a tilting bucket, as disclosed in Patent Literature 1 is known.

CITATION LIST

Patent Literature

Patent Literature 1: WO 2015/186179 A

SUMMARY

Technical Problem

In a technical field related to control of a work machine, working device control of controlling the position or the attitude of at least one of a boom, an arm, and a bucket of a working device according to a target construction shape indicating a target shape of a construction target is known. When working device control is executed, the bucket is suppressed from moving past the target construction shape and construction is realized according to the target construction shape.

In a work machine having a tilting bucket, control is executed to stop a tilting operation of the bucket so that the bucket does not enter a target construction shape by an operator of the work machine operating a tilting manipulation lever. In such a work machine, an operator may want to stop the tilting operation so as not to enter a target construction shape present on a rear surface of the bucket as well as a target construction shape present on a front side of a tip. Moreover, an operator may want to suppress a member of a work machine as well as the tilting bucket from entering a target construction shape present around the member of the work machine. In such a case, it may not be possible to stop the member even when the member exceeds the target construction shape depending on an attitude of the member and a positional relation with the target construction shape, and there are restrictions on the attitude of the member and the positional relation with the target construction shape.

An object of an aspect of the present invention is to reduce restrictions on control based on an attitude of a member of a work machine and a positional relation with a target construction shape when controlling the operation of the member so as not to enter the target construction shape.

Solution to Problem

According to a first aspect of the present invention, a work machine control system that controls a work machine including a member that rotates about a shaft line, comprises: a determination unit that outputs first information when the member is present on an air side which is a side on which the work machine is present in relation to a target construction shape indicating a target shape of a construction target of the work machine and outputs second information when the member is not present on the air side.

According to a second aspect of the present invention, the work machine control system according to first aspect, further comprises: a working device control unit that allows rotation of the member when the first information is output from the determination unit and does not allow rotation of the member when the second information is output.

According to a third aspect of the present invention, the work machine control system according to aspect 1 or 2, further comprises: a target construction shape generation unit that generates the target construction shape indicating the target shape of the construction target of the work machine, wherein the target construction shape generation unit generates a plurality of the target construction shapes around the member, and the determination unit outputs the first information or the second information with respect to the plurality of target construction shapes.

According to a fourth aspect of the present invention, the work machine control system according to any one of aspects 1 to 3, further comprises: a candidate regulation point position data calculation unit that calculates position data of a regulation point set to the member; an operation plane calculation unit that calculates an operation plane which passes through the regulation point and is orthogonal to the shaft line; and a stop ground shape calculation unit that calculates a stop ground shape in which the target construction shape and the operation plane cross each other, wherein the determination unit outputs the first information or the second information using a distance between the stop ground shape and the regulation point, a first vector extending in a direction orthogonal to the target construction shape, and a second vector extending in an extension direction of the shaft line.

The work machine control system according to any one of aspects 1 to 3, further comprises: a known reference point which is located at a position of a portion different from the member of the work machine; and a candidate regulation point position data calculation unit that calculates position data of a regulation point set to the member, wherein the determination unit calculates the number of intersections between the target construction shape and a line segment that connects the reference point and the regulation point and outputs the first information or the second information using whether the number is an even number or an odd number.

According to a sixth aspect of the present invention, a work machine comprises: an upper swinging body; a lower traveling body that supports the upper swinging body; a working device which includes a boom that rotates about a first shaft, an arm that rotates about a second shaft, and a bucket that rotates about a third shaft, the working device being supported on the upper swinging body; and a work machine control system according to any one of aspects 1 to 5, wherein the member is at least one of the bucket, the arm, the boom, and the upper swinging body.

According to a seventh aspect of the present invention, the work machine according to aspect 6, wherein the member is the bucket and the shaft line is orthogonal to the third shaft.

According to an eighth aspect of the present invention, a work machine control method of controlling a work machine including a member that rotates about a shaft line, comprises: outputting first information when the member is present on an air side which is a side on which the work machine is present in relation to a target construction shape indicating a target shape of a construction target of the work machine; and outputting second information when the member is not present on the air side.

According to the aspect of the present invention, it is possible to reduce restrictions on control based on an attitude of a member of a work machine and a positional relation with a target construction shape when controlling the operation of the member so as not to enter the target construction shape.

DESCRIPTION OF EMBODIMENTS

Modes (present embodiments) for carrying out the present invention will be described in detail with reference to the drawings.

In the following description, a global coordinate system (Xg-Yg-Zg coordinate system) and a vehicle body coordinate system (X-Y-Z coordinate system) are set to describe the positional relation between respective portions. The global coordinate system is a coordinate system indicating an absolute position defined by a global navigation satellite system (GNSS) like a global positioning system (GPS). The vehicle body coordinate system is a coordinate system indicating the relative position in relation to a reference position of a work machine.

In the present embodiment, stop control refers to control of stopping an operation of at least a portion of a work machine based on the distance between the work machine and a target construction shape of a construction target of the work machine. For example, when the bucket of the work machine is a tilting bucket, the stop control may involve control of stopping a tilting operation of the bucket based on the distance between the work machine and a target construction shape.

[Work Machine]

Figure 1:
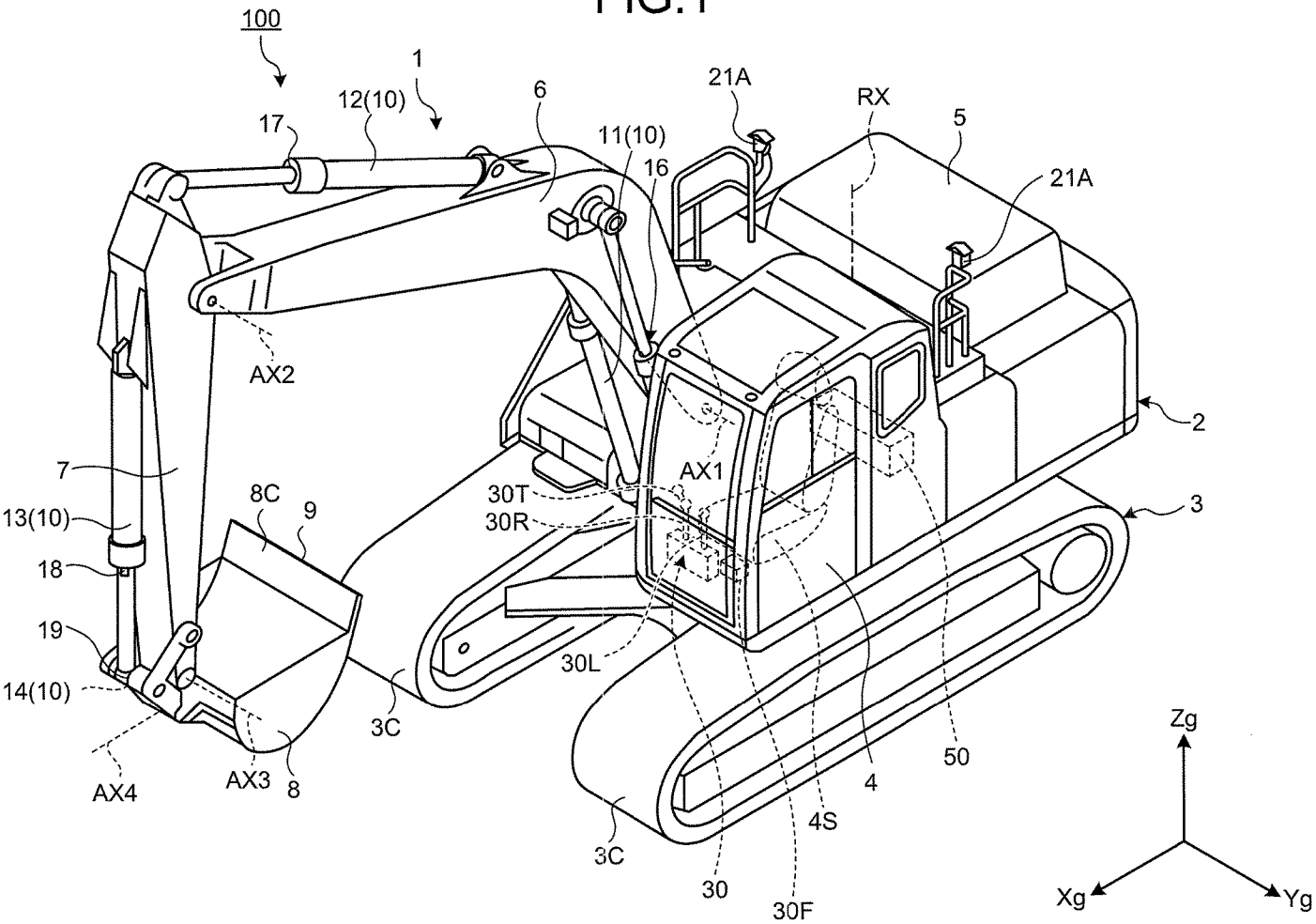
FIG. 1 is a perspective view illustrating an example of a work machine according to the present embodiment.

FIG. 1 is a perspective view illustrating an example of a work machine according to the present embodiment. In the present embodiment, an example in which the work machine is an excavator 100 will be described. The work machine is not limited to the excavator 100.

As illustrated in FIG. 1, the excavator 100 includes a working device 1 that operates with hydraulic pressure, an upper swinging body 2 which is vehicle body that supports the working device 1, a lower traveling body 3 which is a traveling device that supports the upper swinging body 2, a manipulation device 30 for operating the working device 1, and a control device 50 that controls the working device 1. The upper swinging body 2 can swing about a swing axis RX in a state of being supported on the lower traveling body 3.

The upper swinging body 2 has a cab 4 on which an operator boards and a machine room 5 in which an engine and a hydraulic pump are accommodated. The cab 4 has a driver's seat 4S on which the operator sits. The machine room 5 is disposed on the rear side of the cab 4.

The lower traveling body 3 has a pair of crawler belts 3C. The excavator 100 travels when the crawler belt 3C rotates. The lower traveling body 3 may have tires.

The working device 1 is supported on the upper swinging body 2. The working device 1 has a boom 6 connected to the upper swinging body 2 with a boom pin interposed therebetween, an arm 7 connected to the boom 6 with an arm pin interposed therebetween, and a bucket 8 connected to the arm 7 with a bucket pin and a tilting pin interposed therebetween. The bucket 8 has a blade 8C. The blade 8C is a planar member provided at a distal end of the bucket 8 (that is, a portion distant from the portion connected by the bucket pin). A tip 9 of the blade 8C is a distal end of the blade 8C, and in the present embodiment, is a straight portion. When a plurality of convex blades is formed on the bucket 8, the tip 9 is the distal end of the convex blade.

The boom 6 can rotate about a boom shaft AX1 which is a first shaft in relation to the upper swinging body 2. The arm 7 can rotate about an arm shaft AX2 which is a second shaft in relation to the boom 6. The bucket 8 can rotate about a bucket shaft AX3 which is a third shaft and a tilting shaft AX4 which is a shaft line orthogonal to an axis parallel to the bucket shaft AX3 in relation to the arm 7. The bucket shaft AX3 and the tilting shaft AX4 do not cross each other.

The boom shaft AX1, the arm shaft AX2, and the bucket shaft AX3 are parallel to each other. The boom shaft AX1, the arm shaft AX2, and the bucket shaft AX3 are orthogonal to an axis parallel to a swing axis RX. The boom shaft AX1, the arm shaft AX2, and the bucket shaft AX3 are parallel to the Y-axis of the vehicle body coordinate system. The swing axis RX is parallel to the Z-axis of the vehicle body coordinate system. The direction parallel to the boom shaft AX1, the arm shaft AX2, and the bucket shaft AX3 indicates a vehicle width direction of the upper swinging body 2. The direction parallel to the swing axis RX indicates an up-down direction of the upper swinging body 2. The direction orthogonal to the boom shaft AX1, the arm shaft AX2, the bucket shaft AX3, and the swing axis RX indicates a front-rear direction of the upper swinging body 2. A direction in which the working device 1 is present about the driver's seat 4S is the front side.

The working device 1 operates with the force generated by a hydraulic cylinder 10. The hydraulic cylinder 10 includes a boom cylinder 11 that operates the boom 6, an arm cylinder 12 that operates the arm 7, and a bucket cylinder 13 and a tilting cylinder 14 that operate the bucket 8.

The working device 1 has a boom stroke sensor 16, an arm stroke sensor 17, a bucket stroke sensor 18, and a tilting stroke sensor 19. The boom stroke sensor 16 detects a boom stroke indicating an operation amount of the boom cylinder 11. The arm stroke sensor 17 detects an arm stroke indicating an operation amount of the arm cylinder 12. The bucket stroke sensor 18 detects a bucket stroke indicating an operation amount of the bucket cylinder 13. The tilting stroke sensor 19 detects a tilting stroke indicating an operation amount of the tilting cylinder 14.

The manipulation device 30 is disposed in the cab 4. The manipulation device 30 includes an operating member operated by the operator of the excavator 100. The operator operates the manipulation device 30 to operate the working device 1. In the present embodiment, the manipulation device 30 includes a left manipulation lever 30L, a right manipulation lever 30R, a tilting manipulation lever 30T, and a manipulation pedal 30F.

The boom 6 performs a lowering operation when the right manipulation lever 30R at a neutral position is operated forward, and the boom 6 performs a raising operation when the right manipulation lever 30R is operated backward. The bucket 8 performs a dumping operation when the right manipulation lever 30R at the neutral position is operated rightward, and the bucket 8 performs a scooping operation when the right manipulation lever 30R is operated leftward.

The arm 7 performs an extending operation when the left manipulation lever 30L at the neutral position is operated forward, and the arm 7 performs a scooping operation when the left manipulation lever 30L is operated backward. The upper swinging body 2 swings rightward when the left manipulation lever 30L at the neutral position is operated rightward, and the upper swinging body 2 swings leftward when the left manipulation lever 30L is operated leftward.

The relations between the operation direction of the right manipulation lever 30R and the left manipulation lever 30L, the operation direction of the working device 1, and the swing direction of the upper swinging body 2 may be different from the above-described relations.

A control device 50 includes a computer system. The control device 50 has a processor such as a central processing unit (CPU), a storage device including a nonvolatile memory such as a read only memory (ROM) and a volatile memory such as a random access memory (RAM), and an input and output interface device.

[Bucket]

Figure 2:
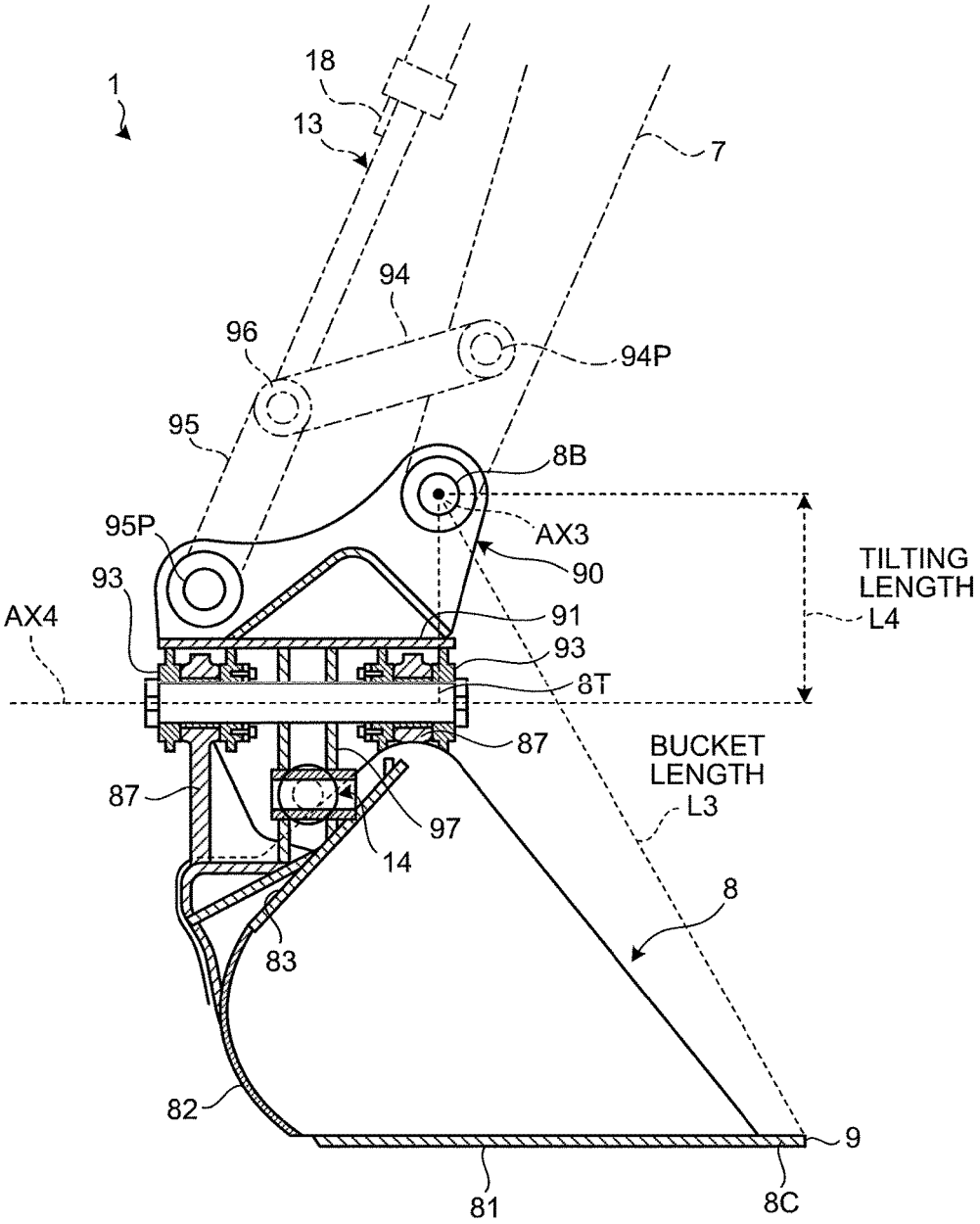
FIG. 2 is a side sectional view illustrating an example of a bucket according to the present embodiment.
Figure 3:
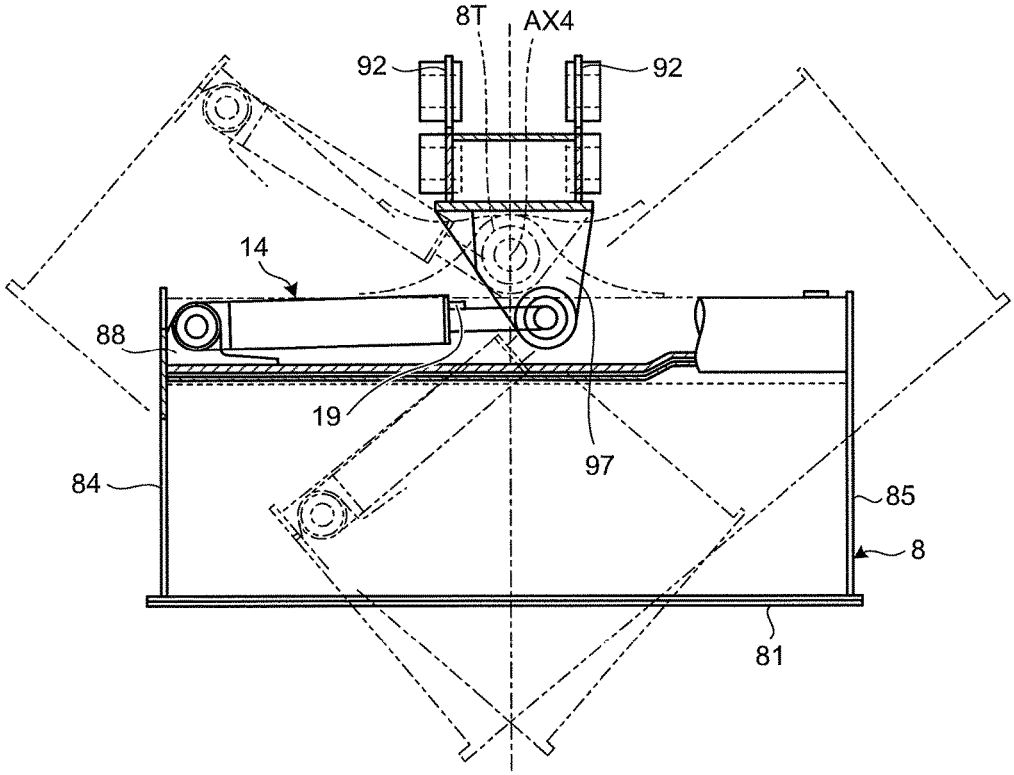
FIG. 3 is a front view illustrating an example of the bucket according to the present embodiment.

FIG. 2 is a side sectional view illustrating an example of the bucket 8 according to the present embodiment. FIG. 3 is a front view illustrating an example of the bucket 8 according to the present embodiment. In the present embodiment, the bucket 8 is a tilting bucket. The tilting bucket is a bucket that operates (for example, rotates) about the tilting shaft AX4 which is a shaft line. In the present embodiment, a member that rotates about a shaft line is the bucket 8.

The bucket 8 is not limited to the tilting bucket. The bucket 8 may be a rotating bucket. The rotating bucket is a bucket that rotates about a shaft line that vertically crosses the bucket shaft AX3.

As illustrated in FIGS. 2 and 3, the bucket 8 is rotatably connected to the arm 7 with a bucket pin 8B interposed therebetween. The bucket 8 is rotatably supported by the arm 7 with a tilting pin 8T interposed therebetween. The bucket 8 is connected to the distal end of the arm 7 with a connection member 90 interposed therebetween. The bucket pin 8B connects the arm 7 and the connection member 90. The tilting pin 8T connects the connection member 90 and the bucket 8. The bucket 8 is rotatably connected to the arm 7 with the connection member 90 interposed therebetween.

The bucket 8 includes a bottom plate 81, a rear plate 82, an upper plate 83, a side plate 84, and a side plate 85. The bucket 8 has a bracket 87 provided in an upper portion of the upper plate 83. The bracket 87 is provided at a front-rear position of the upper plate 83. The bracket 87 is connected to the connection member 90 and the tilting pin 8T.

The connection member 90 has a plate member 91, a bracket 92 provided on an upper surface of the plate member 91, and a bracket 93 provided on a lower surface of the plate member 91. The bracket 92 is connected to the arm 7 and a second link pin 95P. The bracket 93 is provided on an upper portion of the bracket 87 and is connected to the tilting pin 8T and the bracket 87.

The bucket pin 8B connects the bracket 92 of the connection member 90 and the distal end of the arm 7. The tilting pin 8T connects the bracket 93 of the connection member 90 and the bracket 87 of the bucket 8. The connection member 90 and the bucket 8 can rotate about the bucket shaft AX3 in relation to the arm 7. The bucket 8 can rotate about the tilting shaft AX4 in relation to the connection member 90.

The working device 1 has a first link member 94 that is rotatably connected to the arm 7 with a first link pin 94P interposed therebetween and a second link member 95 that is rotatably connected to the bracket 92 with a second link pin 95P interposed therebetween. A base end of the first link member 94 is connected to the arm 7 with the first link pin 94P interposed therebetween. A base end of the second link member 95 is connected to the bracket 92 with a second link pin 95P interposed therebetween. The distal end of the first link member 94 and the distal end of the second link member 95 are connected by a bucket cylinder top pin 96.

The distal end of the bucket cylinder 13 is rotatably connected to the distal end of the first link member 94 and the distal end of the second link member 95 with the bucket cylinder top pin 96 interposed therebetween. When the bucket cylinder 13 extends and retracts, the connection member 90 rotates about the bucket shaft AX3 together with the bucket 8.

The tilting cylinder 14 is connected to a bracket 97 provided in the connection member 90 and a bracket 88 provided in the bucket 8. The rod of the tilting cylinder 14 is connected to the bracket 97 with a pin interposed therebetween. A body portion of the tilting cylinder 14 is connected to the bracket 88 with a pin interposed therebetween. When the tilting cylinder 14 extends and retracts, the bucket 8 rotates about the tilting shaft AX4. The connection structure of the tilting cylinder 14 is an example and is not limited to the structure of the present embodiment.

In this manner, the bucket 8 rotates about the bucket shaft AX3 when the bucket cylinder 13 operates. The bucket 8 rotates about the tilting shaft AX4 when the tilting cylinder 14 operates. When the bucket 8 rotates about the bucket shaft AX3, the tilting pin 8T rotates together with the bucket 8.

[Detection System]

Figure 4:
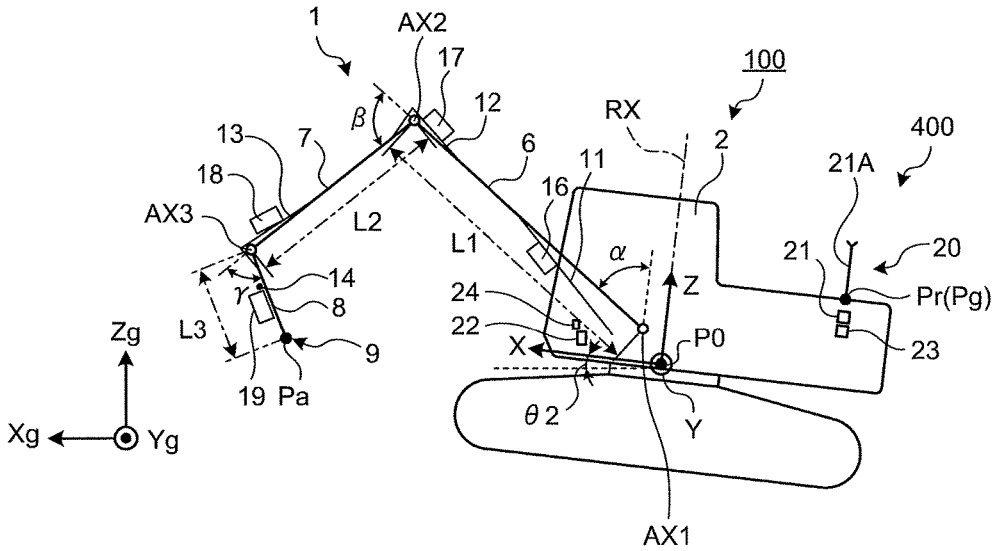
FIG. 4 is a side view schematically illustrating an excavator.
Figure 5:
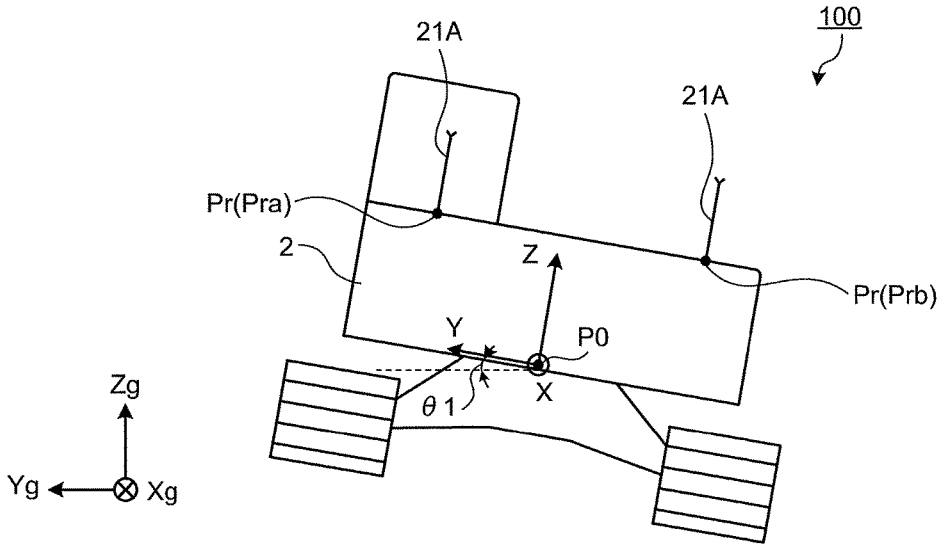
FIG. 5 is a rear view schematically illustrating an excavator.
Figure 6:
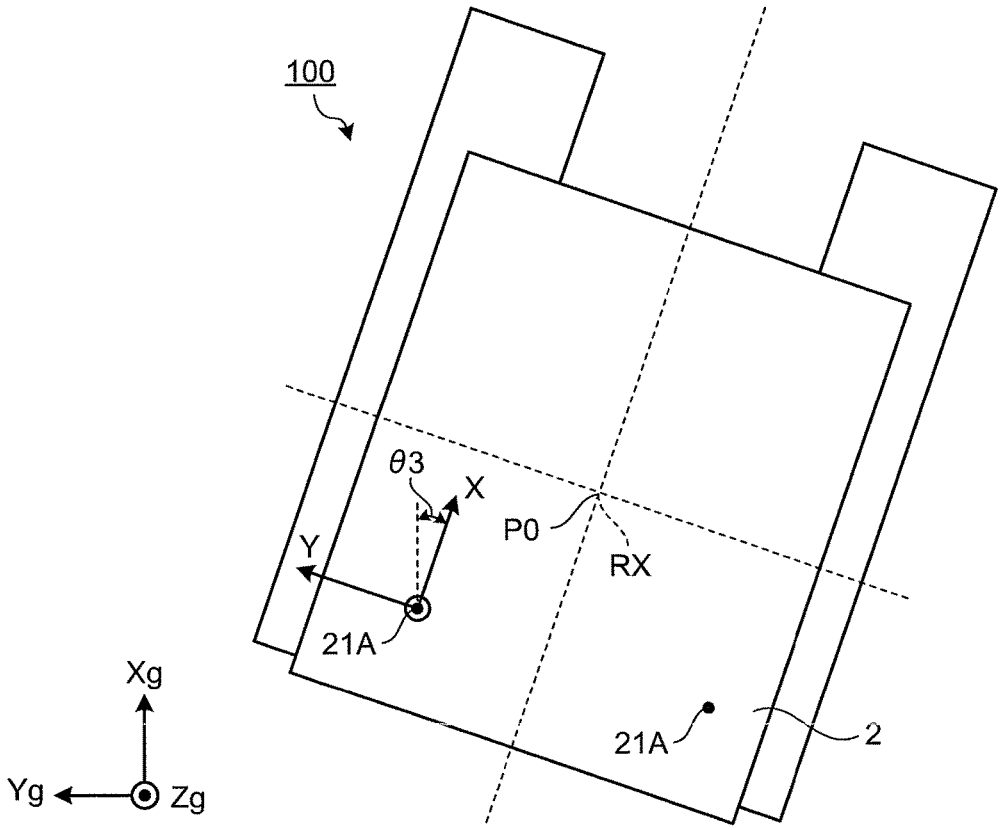
FIG. 6 is a plan view schematically illustrating an excavator.
Figure 7:
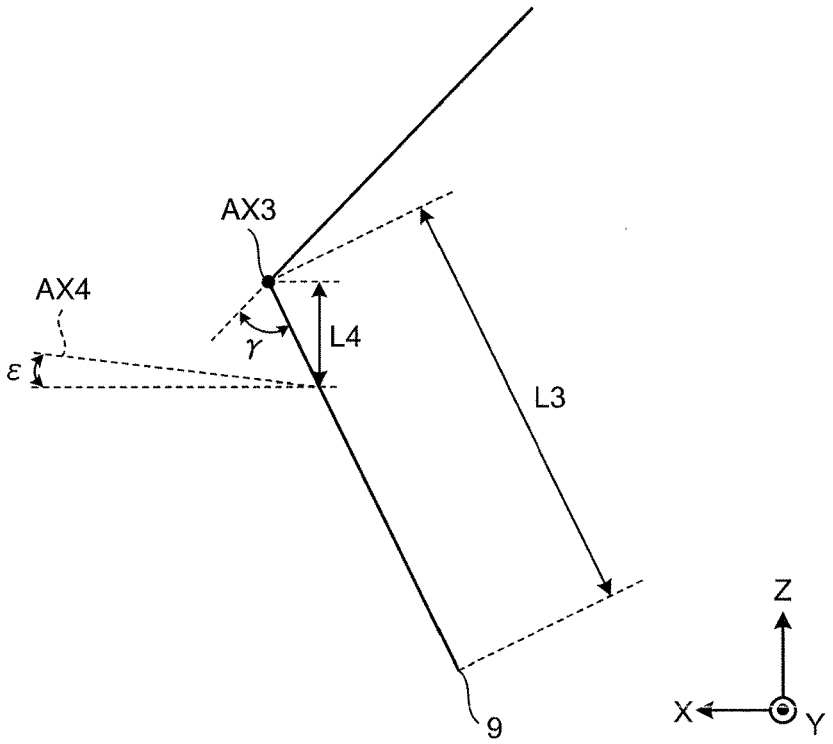
FIG. 7 is a side view schematically illustrating a bucket.
Figure 8:
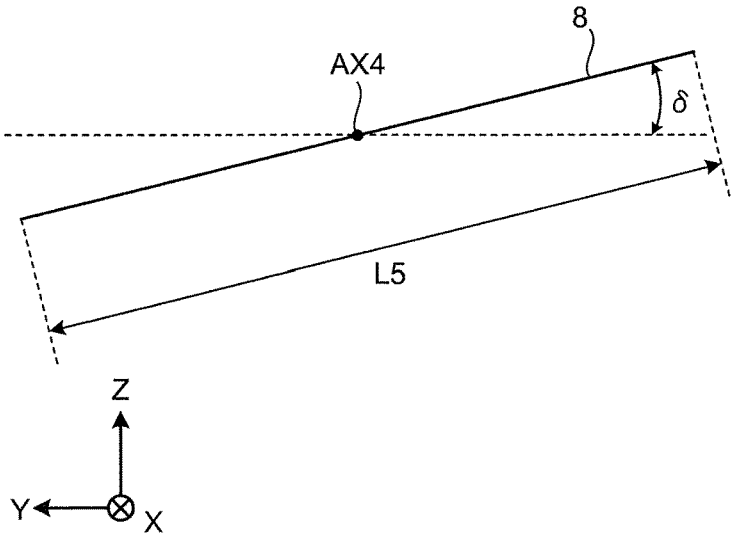
FIG. 8 is a front view schematically illustrating a bucket.

Next, a detection system 400 of the excavator 100 will be described. FIG. 4 is a side view schematically illustrating the excavator 100. FIG. 5 is a rear view schematically illustrating the excavator 100. FIG. 6 is a plan view schematically illustrating the excavator 100. FIG. 7 is a side view schematically illustrating the bucket 8. FIG. 8 is a front view schematically illustrating the bucket 8.

As illustrated in FIGS. 4, 5, and 6, the detection system 400 has a position detection device 20 that detects the position of the upper swinging body 2 and a working device angle detection device 24 that detects the angle of the working device 1. The position detection device 20 includes a vehicle body position calculator 21 that detects the position of the upper swinging body 2, a posture calculator 22 that detects the attitude of the upper swinging body 2, and an orientation calculator 23 that detects the direction of the upper swinging body 2.

The vehicle body position calculator 21 includes a GPS receiver. The vehicle body position calculator 21 is provided in the upper swinging body 2. The vehicle body position calculator 21 detects an absolute position Pg (that is, the position in the global coordinate system (Xg-Yg-Zg)) of the upper swinging body 2 defined by the global coordinate system. The absolute position Pg of the upper swinging body 2 includes coordinate data in the Xg-axis direction, coordinate data in the Yg-axis direction, and coordinate data in the Zg-axis direction.

A plurality of GPS antennas 21A is installed in the upper swinging body 2. The GPS antenna 21A receives radio waves from GPS satellites, generates a signal based on the received radio waves, and outputs the generated signal to the vehicle body position calculator 21. The vehicle body position calculator 21 detects an installed position Pr of the GPS antenna 21A, defined by the global coordinate system based on the signal supplied from the GPS antenna 21A. The vehicle body position calculator 21 detects the absolute position Pg of the upper swinging body 2 based on the installed position Pr of the GPS antenna 21A.

Two GPS antennas 21A are installed in a vehicle width direction. The vehicle body position calculator 21 detects the installed position Pra of one GPS antenna 21A and the installed position Prb of the other GPS antenna 21A. The vehicle body position calculator 21 executes an arithmetic process based on at least one of the positions Pra and Prb to detect the absolute position Pg of the upper swinging body 2. In the present embodiment, the absolute position Pg of the upper swinging body 2 is the position Pra. The absolute position Pg of the upper swinging body 2 may be the position Prb and may be a position located between the positions Pra and Prb.

The posture calculator 22 includes an inertial measurement unit (IMU). The posture calculator 22 is provided in the upper swinging body 2. The posture calculator 22 detects an inclination angle of the upper swinging body 2 with respect to a horizontal plane (that is, the Xg-Yg plane) defined by the global coordinate system. The inclination angle of the upper swinging body 2 with respect to the horizontal plane includes a roll angle θ1 indicating the inclination angle of the upper swinging body 2 in the vehicle width direction and a pitch angle θ2 indicating the inclination angle of the upper swinging body 2 in the front-rear direction.

The orientation calculator 23 detects the direction of the upper swinging body 2 in relation to a reference direction defined by the global coordinate system based on the installed position Pra of one GPS antenna 21A and the installed position Prb of the other GPS antenna 21A. The orientation calculator 23 executes an arithmetic process based on the positions Pra and Prb to detect the direction of the upper swinging body 2 with reference to the reference direction. The orientation calculator 23 calculates a straight line connecting the positions Pra and Prb and detects the direction of the upper swinging body 2 with respect to the reference direction based on the angle between the calculated straight line and the reference direction. The direction of the upper swinging body 2 with respect to the reference direction includes a yaw angle θ3 indicating the angle between the reference direction and the direction of the upper swinging body 2.

As illustrated in FIGS. 4, 7, and 8, the working device angle detection device 24 calculates a boom angle α indicating the inclination angle of the boom 6 with respect to the Z-axis of the vehicle body coordinate system based on the boom stroke detected by the boom stroke sensor 16. The working device angle detection device 24 calculates an arm angle β indicating the inclination angle of the arm 7 with respect to the boom 6 based on the arm stroke detected by the arm stroke sensor 17. The working device angle detection device 24 calculates a bucket angle γ indicating the inclination angle of the tip 9 of the bucket 8 with respect to the arm 7 based on the bucket stroke detected by the bucket stroke sensor 18. The working device angle detection device 24 calculates a tilting angle δ indicating the inclination angle of the bucket 8 with respect to the XY plane based on the tilting stroke detected by the tilting stroke sensor 19. The working device angle detection device 24 calculates a tilting axis angle s indicating the inclination angle of the tilting shaft AX4 with respect to the XY plane based on the boom stroke detected by the boom stroke sensor 16, the arm stroke detected by the arm stroke sensor 17, the bucket stroke detected by the bucket stroke sensor 18, and the tilting stroke detected by the tilting stroke sensor 19. The inclination angle of the working device 1 may be detected by an angular sensor other than the stroke sensor and may be detected by an optical measurement unit such as a stereo camera and a laser scanner.

[Hydraulic System]

Figure 9:
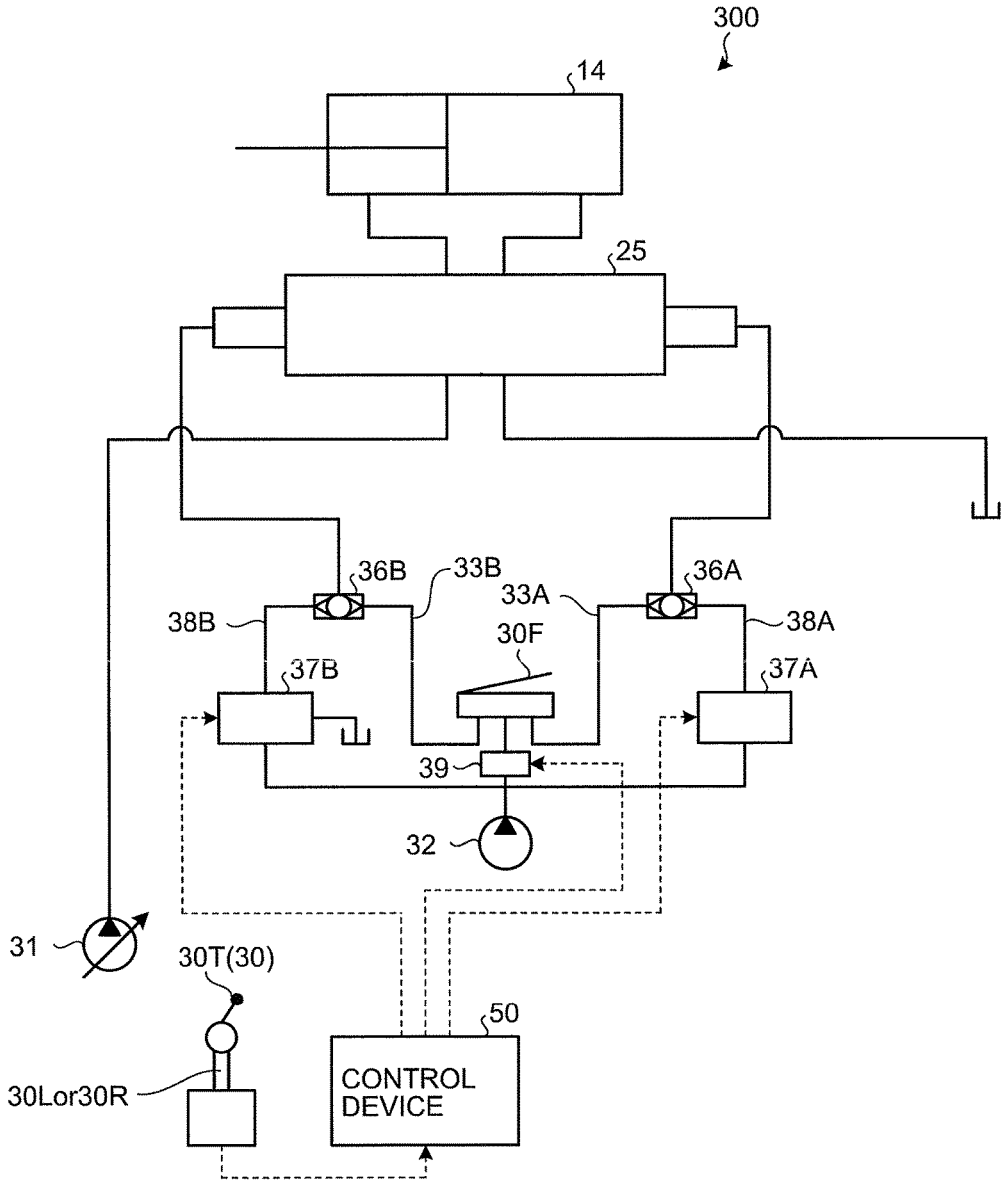
FIG. 9 is a diagram schematically illustrating an example of a hydraulic system that operates a tilting cylinder.

FIG. 9 is a diagram schematically illustrating an example of a hydraulic system 300 that operates the tilting cylinder 14. The hydraulic system 300 includes a variable capacitance-type main hydraulic pump 31 that supplies operating oil, a pilot pressure pump 32 that supplies pilot oil, a flow rate control valve 25 that adjusts the amount of operating oil supplied to the tilting cylinder 14, control valves 37A, 37B, and 39 that adjust the pilot pressure applied to the flow rate control valve 25, a tilting manipulation lever 30T and a manipulation pedal 30F of the manipulation device 30, and a control device 50. The tilting manipulation lever 30T is a button or the like provided in at least one of the left manipulation lever 30L and the right manipulation lever 30R. In the present embodiment, the manipulation pedal 30F of the manipulation device 30 is a pilot pressure-type manipulation device. The tilting manipulation lever 30T of the manipulation device 30 is an electromagnetic lever-type manipulation device.

The manipulation pedal 30F of the manipulation device 30 is connected to the pilot pressure pump 32. The control valve 39 is provided between the manipulation pedal 30F and the pilot pressure pump 32. Moreover, the manipulation pedal 30F is connected to an oil passage 38A through which the pilot oil delivered from the control valve 37A flows via a shuttle valve 36A. Moreover, the manipulation pedal 30F is connected to an oil passage 38B through which the pilot oil delivered from the control valve 37B flows via a shuttle valve 36B. When the manipulation pedal 30F is operated, the pressure of an oil passage 33A between the manipulation pedal 30F and the shuttle valve 36A and the pressure of an oil passage 33B between the manipulation pedal 30F and the shuttle valve 36B are adjusted.

When the tilting manipulation lever 30T is operated, an operation signal generated by the operation of the tilting manipulation lever 30T is output to the control device 50. The control device 50 generates a control signal based on the operation signal output from the tilting manipulation lever 30T and controls the control valves 37A and 37B. The control valves 37A and 37B are electromagnetic proportional control valves. The control valve 37A opens and closes the oil passage 38A based on the control signal. The control valve 37B opens and closes the oil passage 38B based on the control signal.

When tilting stop control is not executed, the pilot pressure is adjusted based on the operation amount of the manipulation device 30. When tilting stop control is executed, the control device 50 outputs a control signal to the control valves 37A and 37B or the control valve 39 to adjust the pilot pressure.

[Control System]

Figure 10:
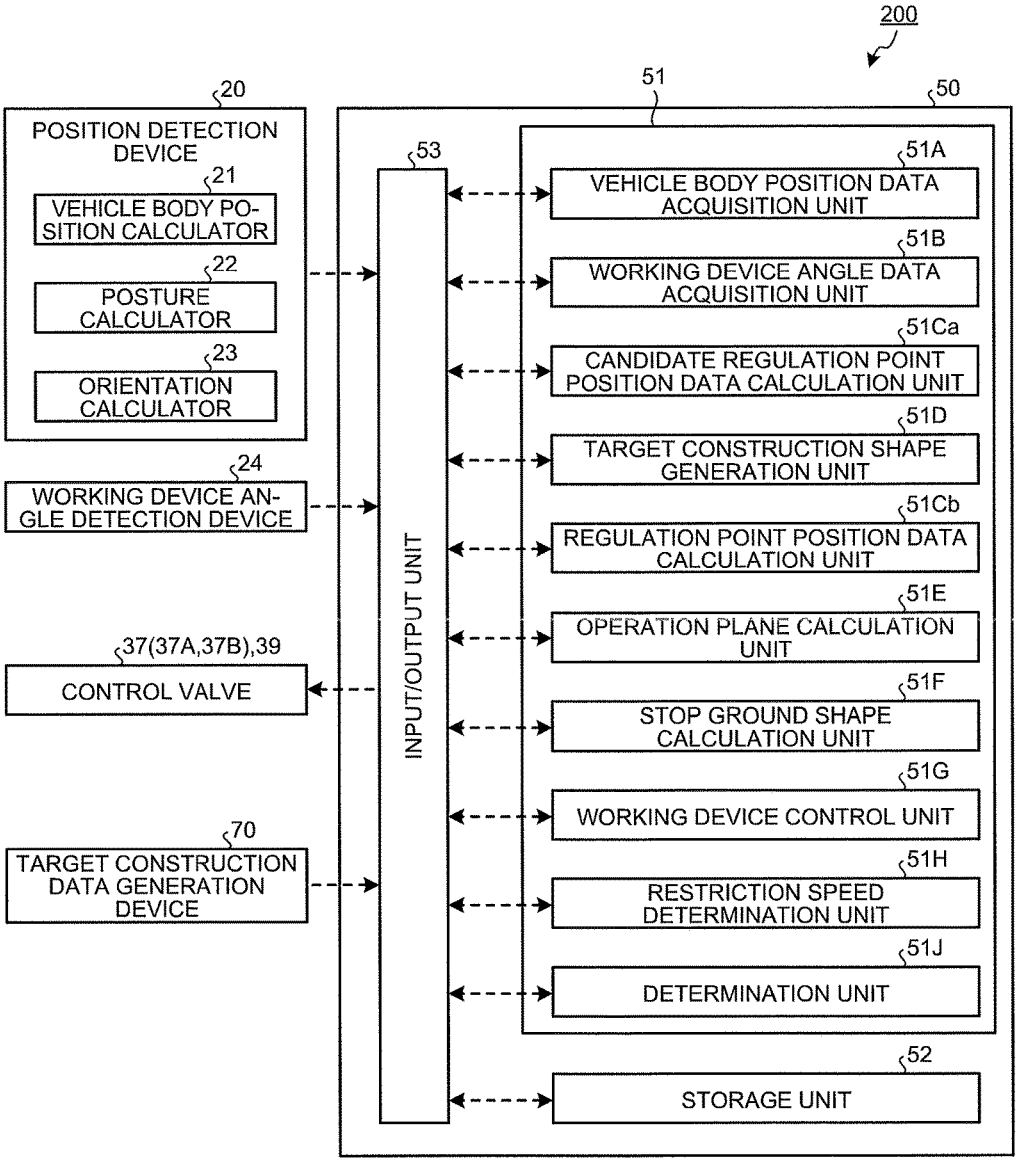
FIG. 10 is a functional block diagram illustrating an example of a control system of a work machine according to the present embodiment.

FIG. 10 is a functional block diagram illustrating an example of a control system 200 of the work machine according to the present embodiment. In the following description, the control system 200 of the work machine will be appropriately referred to as the control system 200. As illustrated in FIG. 10, the control system 200 includes the control device 50 that controls the working device 1, the position detection device 20, the working device angle detection device 24, a control valve 37 (37A, 37B) and 39, and a target construction data generation device 70.

The position detection device 20 detects the absolute position Pg of the upper swinging body 2, the attitude of the upper swinging body 2 including the roll angle θ1 and the pitch angle θ2, and the direction of the upper swinging body 2 including the yaw angle θ3. The working device angle detection device 24 detects the angle of the working device 1 including the boom angle α, the arm angle β, the bucket angle γ, the tilting angle δ, and the tilting axis angle ε. The control valve 37 (37A, 37B) adjusts the amount of the operating oil supplied to the tilting cylinder 14.

The control valve 37 operates based on the control signal supplied from the control device 50. The target construction data generation device 70 includes a computer system. The target construction data generation device 70 generates target construction data indicating a target ground shape which is a target shape of a construction area. The target construction data indicates three-dimensional target shape obtained after construction is finished by the working device 1.

The target construction data generation device 70 is provided in a place remote from the excavator 100. The target construction data generation device 70 is provided in a construction management facility, for example. The target construction data generation device 70 can wirelessly communicate with the control device 50. The target construction data generated by the target construction data generation device 70 is wirelessly transmitted to the control device 50.

The target construction data generation device 70 and the control device 50 may be connected by cables, and the target construction data may be transmitted from the target construction data generation device 70 to the control device 50. The target construction data generation device 70 may include a recording medium that stores the target construction data, and the control device 50 may have a device capable of reading the target construction data from the recording medium.

The target construction data generation device 70 may be provided in the excavator 100. The target construction data may be supplied in a wired or wireless manner from an external management device that manages construction to the target construction data generation device 70 of the excavator 100, and the target construction data generation device 70 may store the supplied target construction data.

The control device 50 includes a processing unit 51, a storage unit 52, and an input/output unit 53. The processing unit 51 has a vehicle body position data acquisition unit 51A, a working device angle data acquisition unit 51B, a candidate regulation point position data calculation unit 51Ca, a target construction shape generation unit 51D, a regulation point position data calculation unit 51Cb, an operation plane calculation unit 51E, a stop ground shape calculation unit 51F, a working device control unit 51G, a restriction speed determination unit 51H, and a determination unit 51J. The storage unit 52 stores specification data of the excavator 100 including working device data.

The respective functions of the vehicle body position data acquisition unit 51A, the working device angle data acquisition unit 51B, the candidate regulation point position data calculation unit 51Ca, the target construction shape generation unit 51D, the regulation point position data calculation unit 51Cb, the operation plane calculation unit 51E, the stop ground shape calculation unit 51F, the working device control unit 51G, the restriction speed determination unit 51H, and the determination unit 51J of the processing unit 51 are realized by a processor of the control device 50. The function of the storage unit 52 is realized by a storage device of the control device 50. The function of the input/output unit 53 is realized by an input and output interface device of the control device 50.

The vehicle body position data acquisition unit 51A acquires vehicle body position data from the position detection device 20 via the input/output unit 53. The vehicle body position data includes the absolute position Pg of the upper swinging body 2 defined by the global coordinate system, the attitude of the upper swinging body 2 including the roll angle θ1 and the pitch angle θ2, and the direction of the upper swinging body 2 including the yaw angle θ3.

The working device angle data acquisition unit 51B acquires the working device angle data from the working device angle detection device 24 via the input/output unit 53. The working device angle data is the angle of the working device 1 including the boom angle α, the arm angle β, the bucket angle γ, the tilting angle δ, and the tilting axis angle ε.

The candidate regulation point position data calculation unit 51Ca calculates the position data of the regulation point RP set to the bucket 8. The candidate regulation point position data calculation unit 51Ca calculates the position data of the regulation point RP set to the bucket 8 based on the vehicle body position data acquired by the vehicle body position data acquisition unit 51A, the working device angle data acquired by the working device angle data acquisition unit 51B, and the working device data stored in the storage unit 52. The regulation point RP will be described later.

As illustrated in FIG. 4, the working device data includes a boom length L1, an arm length L2, a bucket length L3, a tilting length L4, and a bucket width L5. The boom length L1 is the distance between the boom shaft AX1 and the arm shaft AX2. The arm length L2 is the distance between the arm shaft AX2 and the bucket shaft AX3. The bucket length L3 is the distance between the bucket shaft AX3 and the tip 9 of the bucket 8. The tilting length L4 is the distance between the bucket shaft AX3 and the tilting shaft AX4. The bucket width L5 is the distance between the side plate 84 and the side plate 85.

Figure 11:
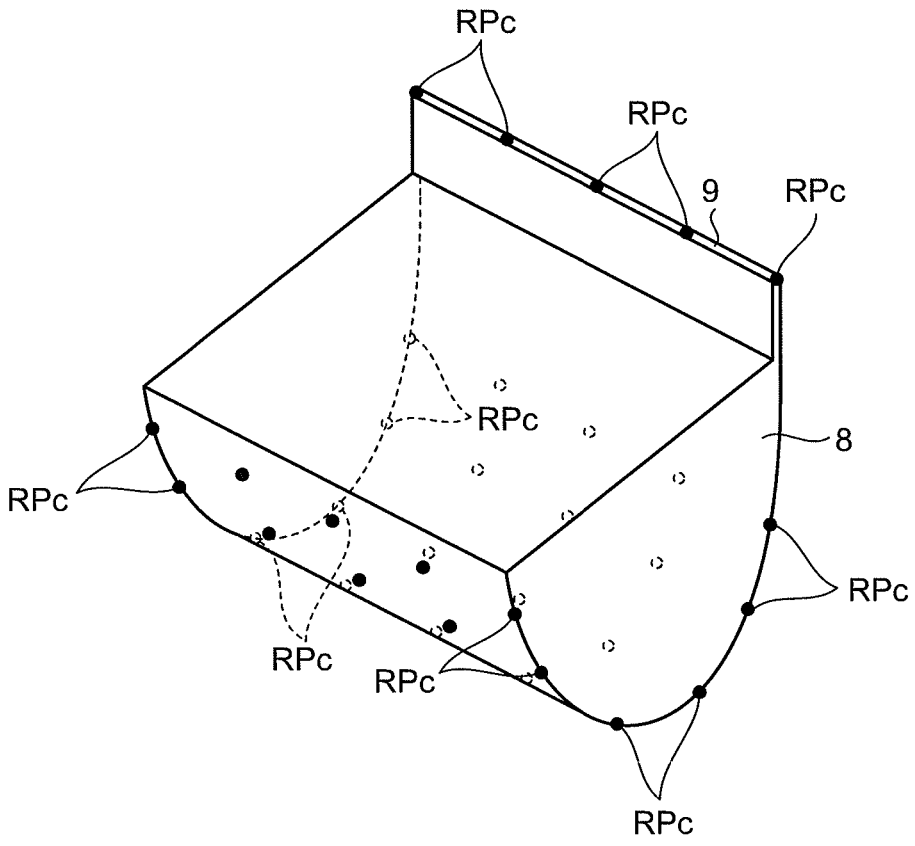
FIG. 11 is a diagram schematically illustrating an example of a regulation point set to a bucket according to the present embodiment.

FIG. 11 is a diagram schematically illustrating an example of the regulation point RP set to the bucket 8 according to the present embodiment. As illustrated in FIG. 11, a plurality of candidate regulation points RPc which are the candidates for the regulation point RP used for tilting bucket control is set to the bucket 8. The candidate regulation point RPc is set to the tip 9 of the bucket 8 and the outer surface of the bucket 8. A plurality of candidate regulation points RPc is set in the bucket width direction of the tip 9. Moreover, a plurality of candidate regulation points RPc is set to the outer surface of the bucket 8. The regulation point RP is one of the candidate regulation points RPc.

The working device data includes bucket shape data indicating the shape and the dimensions of the bucket 8. The bucket shape data includes the bucket width L5. The bucket shape data includes outline data of the outer surface of the bucket 8 and the coordinate data of the plurality of candidate regulation points RPc of the bucket 8 in relation to the tip 9 of the bucket 8.

The candidate regulation point position data calculation unit 51Ca calculates the relative positions of the plurality of candidate regulation points RPc in relation to a reference position P0 of the upper swinging body 2. Moreover, the candidate regulation point position data calculation unit 51Ca calculates the absolute positions of the plurality of candidate regulation points RPc.

The candidate regulation point position data calculation unit 51Ca can calculate the relative positions of the plurality of candidate regulation points RPc of the bucket 8 in relation to the reference position P0 of the upper swinging body 2 based on the working device data including the boom length L1, the arm length L2, the bucket length L3, the tilting length L4, and the bucket shape data and the working device angle data including the boom angle α, the arm angle β, the bucket angle γ, the tilting angle δ, and the tilting axis angle ε. As illustrated in FIG. 4, the reference position P0 of the upper swinging body 2 is set to the swing axis RX of the upper swinging body 2. The reference position P0 of the upper swinging body 2 may be set to the boom shaft AX1.

The candidate regulation point position data calculation unit 51Ca can calculate the absolute position Pa of the bucket 8 based on the absolute position Pg of the upper swinging body 2 detected by the position detection device 20 and the relative position of the bucket 8 in relation to the reference position P0 of the upper swinging body 2. The relative position between the absolute position Pg and the reference position P0 is known data derived from the specification data of the excavator 100. The candidate regulation point position data calculation unit 51Ca can calculate the absolute positions of the plurality of candidate regulation points RPc of the bucket 8 based on the vehicle body position data including the absolute position Pg of the upper swinging body 2, the relative position of the bucket 8 in relation to the reference position P0 of the upper swinging body 2, the working device data, and the working device angle data. The candidate regulation point RPc is not limited to points as long as the candidate regulation point includes the information on the width direction of the bucket 8 and the information on the outer surface of the bucket 8.

The target construction shape generation unit 51D generates a target construction shape CS indicating the target shape of a construction target based on the target construction data supplied from the target construction data generation device 70. The target construction data generation device 70 may supply three-dimensional target ground shape data to the target construction shape generation unit 51D as the target construction data and may supply a plurality of items of line data or a plurality of items of point data indicating a portion of the target shape to the target construction shape generation unit 51D. In the present embodiment, it is assumed that the target construction data generation device 70 supplies line data indicating a portion of the target shape to the target construction shape generation unit 51D as the target construction data.

Figure 12:
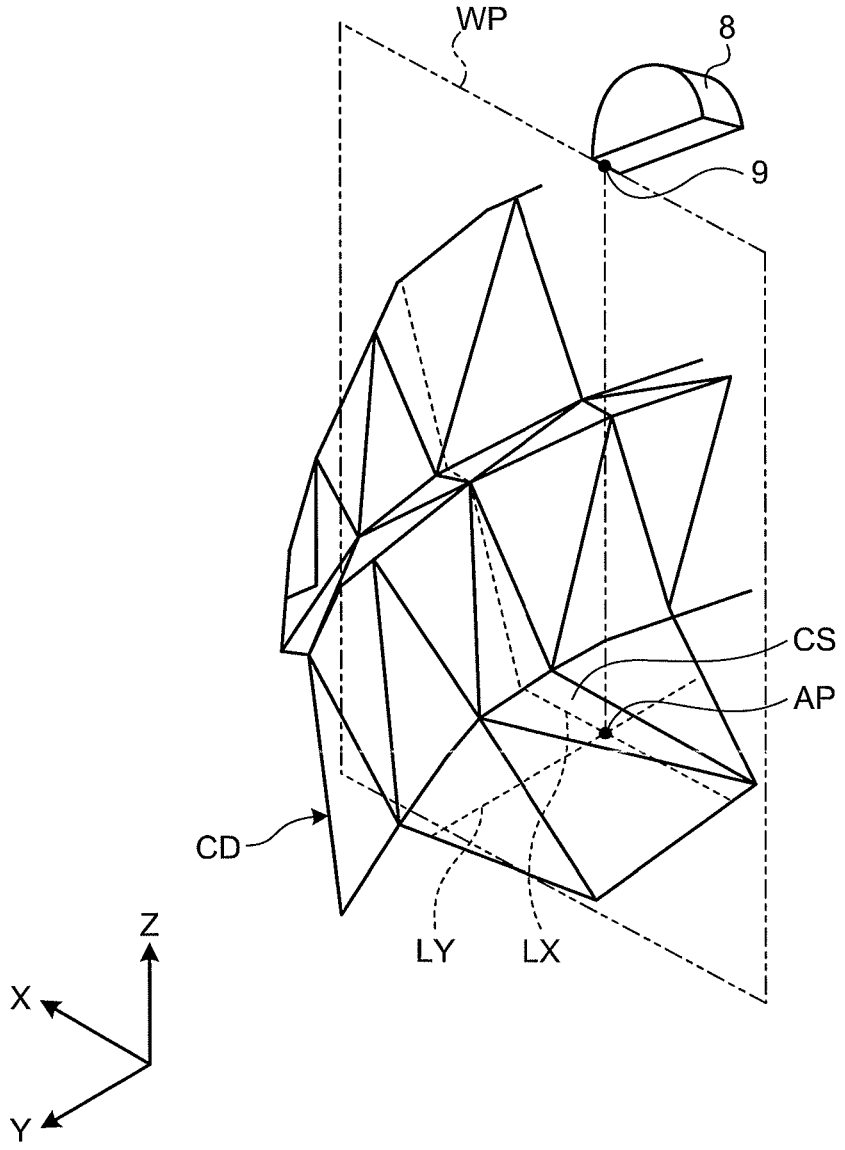
FIG. 12 is a schematic diagram illustrating an example of target construction data according to the present embodiment.

FIG. 12 is a schematic diagram illustrating an example of target construction data CD according to the present embodiment. As illustrated in FIG. 12, the target construction data CD indicates the target ground shape of the construction area. The target ground shape includes a plurality of target construction shapes CS each represented by a triangular polygon. Each of the plurality of target construction shapes CS indicates a target shape of the construction target constructed by the working device 1. In the target construction data CD, a point AP of which the vertical distance to the bucket 8 is the shortest is defined among the target construction shapes CS. Moreover, in the target construction data CD, a working device operation plane WP which passes through the point AP and the bucket 8 and is orthogonal to the bucket shaft AX3 is defined. The working device operation plane WP is an operation plane on which the tip 9 of the bucket 8 moves with the operation of at least one of the boom cylinder 11, the arm cylinder 12, and the bucket cylinder 13 and which is parallel to the XZ plane of the vehicle body coordinate system (X-Y-Z).

The target construction shape generation unit 51D acquires a line LX which is a nodal line between the working device operation plane WP and the target construction shape CS. Moreover, the target construction shape generation unit 51D acquires a line LY which passes through the point AP and crosses the line LX in the target construction shape CS. The line LY indicates a nodal line between the horizontal operation plane and the target construction ground shape CS. The horizontal operation plane is a plane which is orthogonal to the working device operation plane WP and passes through the point AP. The line LY extends in a lateral direction of the bucket 8 in the target construction ground shape CS.

Figure 13:
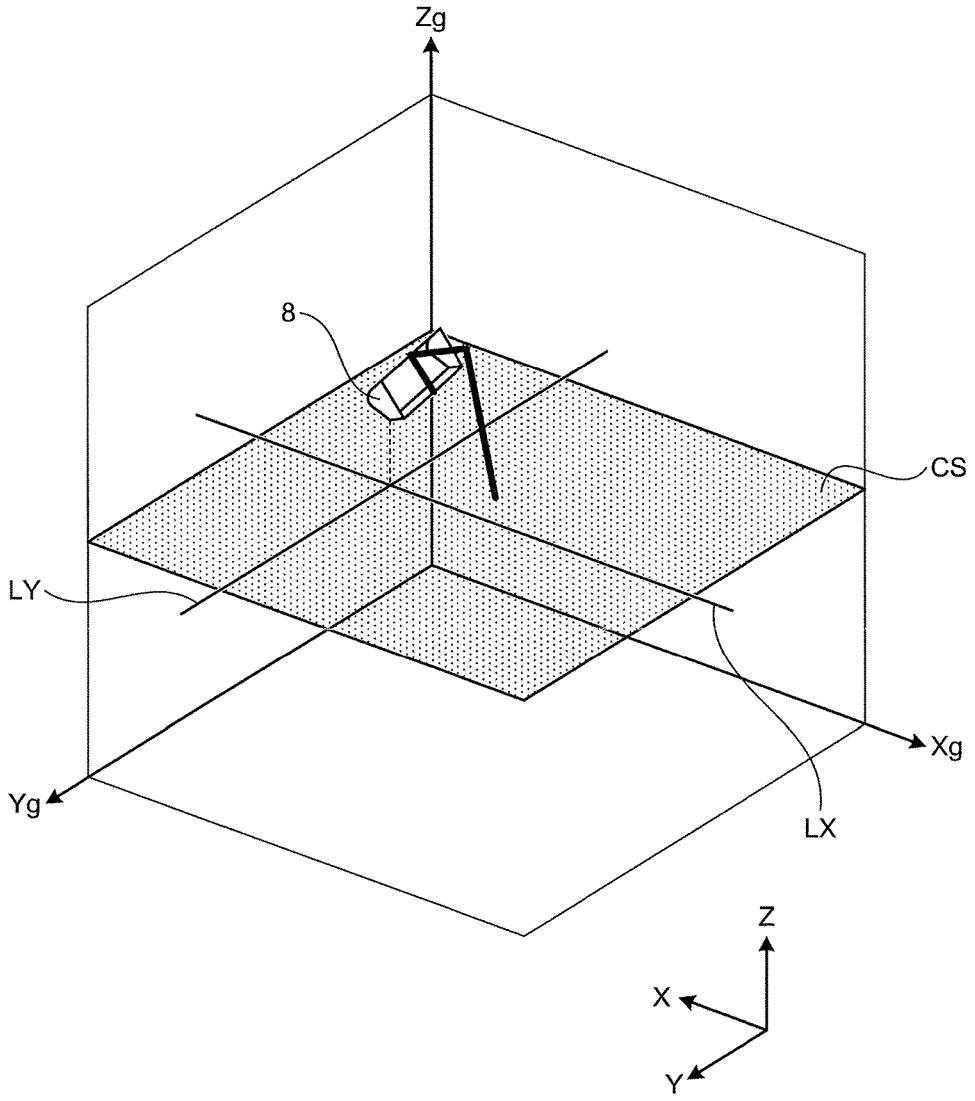
FIG. 13 is a schematic diagram illustrating an example of a target construction shape according to the present embodiment.

FIG. 13 is a schematic diagram illustrating an example of the target construction shape CS according to the present embodiment. The target construction shape generation unit 51D acquires the lines LX and LY to generate the target construction shape CS indicating the target shape of the construction target based on the lines LX and LY. When the target construction shape CS is excavated by the bucket 8, the control device 50 moves the bucket 8 along the line LX which passes through the bucket 8 and is the nodal line between the working device operation plane WP and the target construction shape CS.

In the present embodiment, even when the bucket 8 performs a tilting operation according to tilting control based on the line LY, the vertical distance on the regulation point RP and the line LY is acquired, and the control device 50 can control the bucket 8. Moreover, the control device 50 may perform tilting control based on a line parallel to the line LY based on the shortest distance between the target construction shape CS and the regulation point RP rather than the line LY only.

The operation plane calculation unit 51E calculates an operation plane which passes through a regulation point set to a member and is orthogonal to a shaft line. In the present embodiment, since the shaft line is the tilting shaft AX4 and the member is the bucket 8, the operation plane calculation unit 51E calculates a tilting operation plane TP which passes through the regulation point RP of the bucket 8 which is the member and is orthogonal to the tilting shaft AX4 which is the shaft line. The tilting operation plane TP corresponds to the operation plane described above.

Figure 14:
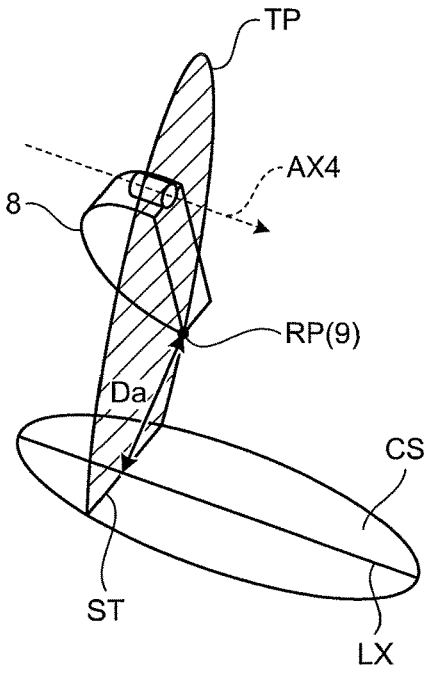
FIG. 14 is a schematic diagram illustrating an example of a tilting operation plane according to the present embodiment.
Figure 15:
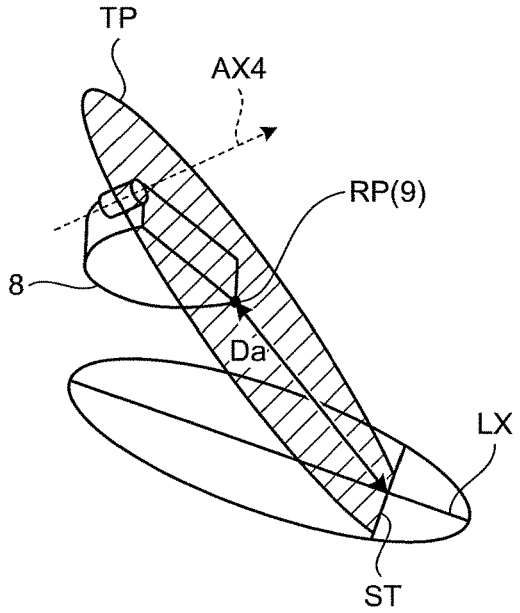
FIG. 15 is a schematic diagram illustrating an example of a tilting operation plane according to the present embodiment.

FIGS. 14 and 15 are schematic diagrams illustrating an example of the tilting operation plane TP according to the present embodiment. FIG. 14 illustrates the tilting operation plane TP when the tilting shaft AX4 is parallel to the target construction shape CS. FIG. 15 illustrates the tilting operation plane TP when the tilting shaft AX4 is not parallel to the target construction shape CS.

As illustrated in FIGS. 14 and 15, the tilting operation plane TP refers to an operation plane which passes through the regulation point RP selected from the plurality of candidate regulation points RPc defined in the bucket 8 and is orthogonal to the tilting shaft AX4. The regulation point RP is a regulation point RP which is determined to be best useful for tilting bucket control among the plurality of candidate regulation points RPc. The regulation point RP which is most useful for tilting bucket control is a regulation point RP of which the distance to the target construction shape CS is the shortest. The regulation point RP which is most useful for tilting bucket control may be a regulation point RP at which the cylinder speed of the hydraulic cylinder 10 is the fastest when tilting bucket control is executed based on the regulation point RP. The regulation point position data calculation unit 51Cb calculates the regulation point RP (specifically, the regulation point RP which is most useful for tilting bucket control) based on the width of the bucket 8, the candidate regulation point RPc which is the outer surface information, and the target construction shape CS.

FIGS. 14 and 15 illustrate the tilting operation plane TP that passes through the regulation point RP set to the tip 9 as an example. The tilting operation plane TP is an operation plane on which the regulation point RP (the tip 9) of the bucket 8 moves with the operation of the tilting cylinder 14. When at least one of the boom cylinder 11, the arm cylinder 12, and the bucket cylinder 13 operates and the tilting axis angle ε indicating the direction of the tilting shaft AX4 changes, the inclination of the tilting operation plane TP also changes.

As described above, the working device angle detection device 24 calculates the tilting axis angle indicating the inclination angle of the tilting shaft AX4 with respect to the XY plane. The tilting axis angle ε is acquired by the working device angle data acquisition unit 51B. Moreover, the position data of the regulation point RP is calculated by the candidate regulation point position data calculation unit 51Ca. The operation plane calculation unit 51E calculates the tilting operation plane TP based on the tilting axis angle ε of the tilting shaft AX4 acquired by the working device angle data acquisition unit 51B and the position of the regulation point RP calculated by the candidate regulation point position data calculation unit 51Ca.

The stop ground shape calculation unit 51F calculates a stop ground shape in which the target construction shape CS and the operation plane cross each other. In the present embodiment, since the operation plane is the tilting operation plane TP, the stop ground shape calculation unit 51F calculates a stop ground shape defined by a portion in which the target construction shape CS and the tilting operation plane TP cross each other. This stop ground shape will be hereinafter appropriately referred to as a tilting stop ground shape ST. The stop ground shape calculation unit 51F calculates a tilting target ground shape ST extending in a lateral direction of the bucket 8 in the target construction ground shape CS based on the position data of the regulation point RP selected from the plurality of candidate regulation points RPc, the target construction ground shape CS, and the tilting data. As illustrated in FIGS. 14 and 15, the tilting stop ground shape ST is represented by a nodal line between the target construction shape CS and the tilting operation plane TP. When the tilting axis angle ε which is the direction of the tilting shaft AX4 changes, the position of the tilting stop ground shape ST changes.

The working device control unit 51G outputs a control signal for controlling the hydraulic cylinder 10. When tilting stop control is executed, the working device control unit 51G executes tilting stop control of stopping the tilting operation of the bucket 8 about the tilting shaft AX4 based on the operation distance Da indicating the distance between the tilting stop ground shape ST and the regulation point RP of the bucket 8. That is, in the present embodiment, tilting stop control is executed based on the tilting stop ground shape ST. In the tilting stop control, the working device control unit 51G controls the bucket 8 to stop at the tilting stop ground shape ST so that the bucket 8 performing a tilting operation does not exceed the tilting stop ground shape ST.

The working device control unit 51G executes tilting stop control based on the regulation point RP of which the operation distance Da is the shortest among the plurality of candidate regulation points RPc set to the bucket 8. That is, the working device control unit 51G executes tilting stop control based on the operation distance Da between the tilting stop ground shape ST and the regulation point RP which is closest to the tilting stop ground shape ST so that the regulation point RP closest to the tilting stop ground shape ST among the plurality of candidate regulation points RPc set to the bucket 8 does not exceed the tilting stop ground shape ST.

The restriction speed determination unit 51H determines a restriction speed U for the tilting operation speed of the bucket 8 based on the operation distance Da. The restriction speed determination unit 51H limits the tilting operation speed when the operation distance Da is equal to or smaller than a line distance H which is a threshold.

The determination unit 51J determines whether the bucket 8 is present on an air side which is the side where the excavator 100 is present in relation to the target construction shape CS. The determination unit 51J outputs first information when the bucket 8 is present on the air side, and the determination unit 51J outputs second information different from the first information when the bucket 8 is not present on the air side. The first information is information indicating that the tilting operation of the bucket 8 is allowed. When the first information is output, the control device 50 can execute tilting stop control. The second information is information indicating that the tilting operation of the bucket 8 is not allowed. When the second information is output, the control device 50 does not execute tilting stop control. In the present embodiment, the restriction speed determination unit 51H may have the determination unit 51J.

Figure 16:
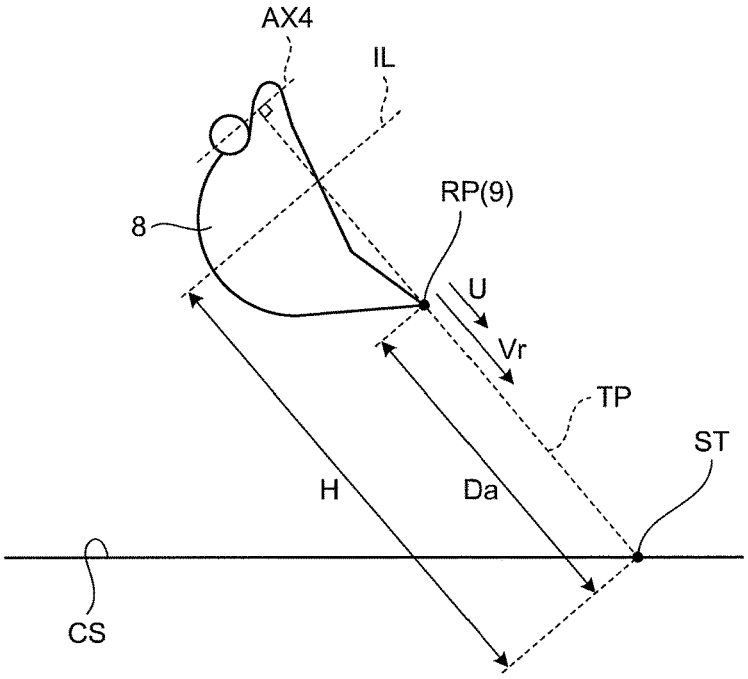
FIG. 16 is a schematic diagram for describing tilting stop control according to the present embodiment.

FIG. 16 is a schematic diagram for describing tilting stop control according to the present embodiment. As illustrated in FIG. 16, the target construction shape CS is defined and a speed limitation intervention line IL is defined. The speed limitation intervention line IL is parallel to the tilting shaft AX4 and is defined at a position separated by the line distance H from the tilting stop ground shape ST. The line distance H is preferably set so as not to impair the sense of operability of the operator. The working device control unit 51G limits the tilting operation speed of the bucket 8 when at least a portion of the bucket 8 performing a tilting operation exceeds the speed limitation intervention line IL and the operation distance Da is equal to or smaller than the line distance H. The restriction speed determination unit 51H determines the restriction speed U for the tilting operation speed of the bucket 8 which has exceeded the speed limitation intervention line IL. In the example illustrated in FIG. 16, since a portion of the bucket 8 exceeds the speed limitation intervention line IL and the operation distance Da is smaller than the line distance H, the tilting operation speed is limited.

The restriction speed determination unit 51H acquires the operation distance Da between the regulation point RP and the tilting stop ground shape ST in the direction parallel to the tilting operation plane TP. Moreover, the restriction speed determination unit 51H acquires the restriction speed U corresponding to the operation distance Da. The working device control unit 51G limits the tilting operation speed when it is determined that the operation distance Da is equal to or smaller than the line distance H.

Figure 17:
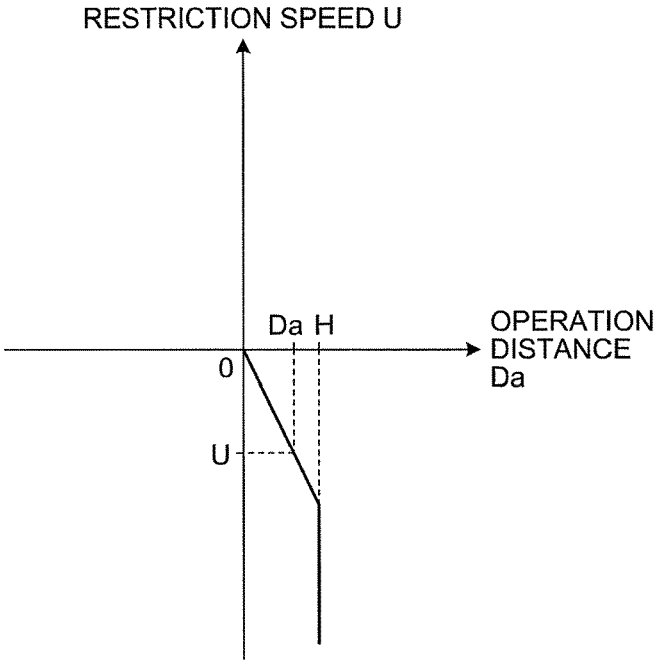
FIG. 17 is a diagram illustrating an example of the relation between an operation distance and a restriction speed in order to stop tilting rotation of a tilting bucket based on an operation distance.

FIG. 17 is a diagram illustrating an example of the relation between the operation distance Da and the restriction speed U in order to stop the tilting rotation of the tilting bucket based on the operation distance Da. As illustrated in FIG. 17, the restriction speed U is a speed determined according to the operation distance Da. The restriction speed U is not set when the operation distance Da is larger than the line distance H and is set when the operation distance Da is equal to or smaller than the line distance H. The smaller the operation distance Da, the smaller the restriction speed U, and the restriction speed U reaches zero when the operation distance Da reaches zero. In FIG. 17, the direction of approaching the target construction shape CS is depicted as a negative direction.

The restriction speed determination unit 51H calculates a movement speed Vr when the regulation point RP moves toward the target construction shape CS (the tilting stop ground shape ST) specified by the target construction data CD based on the operation amount of the tilting manipulation lever 30T of the manipulation device 30. The movement speed Vr is the movement speed of the regulation point RP in a plane parallel to the tilting operation plane TP. The movement speed Vr is calculated for each of the plurality of regulation points RP.

In the present embodiment, when the tilting manipulation lever 30T is operated, the movement speed Vr is calculated based on a current value output from the tilting manipulation lever 30T. When the tilting manipulation lever 30T is operated, a current corresponding to the operation amount of the tilting manipulation lever 30T is output from the tilting manipulation lever 30T. First correlation data indicating the relation between the pilot pressure and the current value output from the tilting manipulation lever 30T is stored in the storage unit 52. Moreover, second correlation data indicating the relation between the pilot pressure and a spool stroke indicating the moving amount of the spool is stored in the storage unit 52. Furthermore, third correlation data indicating the relation between the spool stroke and the cylinder speed of the tilting cylinder 14 is stored in the storage unit 52.

The first, second, and third correlation data are known data obtained in advance through tests, simulations, or the like. The restriction speed determination unit 51H calculates the cylinder speed of the tilting cylinder 14 corresponding to the operation amount of the tilting manipulation lever 30T based on the current value output from the tilting manipulation lever 30T and the first, second, and third correlation data stored in the storage unit 52. An actual detection value of the stroke sensor may be used as the cylinder speed. After the cylinder speed of the tilting cylinder 14 is obtained, the restriction speed determination unit 51H converts the cylinder speed of the tilting cylinder 14 to the movement speed Vr of each of the plurality of regulation points RP of the bucket 8 using the Jacobian determinant.

The working device control unit 51G executes speed limitation to limit the movement speed Vr of the regulation point RP in relation to the target construction shape CS to the restriction speed U when it is determined that the operation distance Da is equal to or smaller than the line distance H. The working device control unit 51G outputs a control signal to the control valve 37 in order to suppress the movement speed Vr of the regulation point RP of the bucket 8. The working device control unit 51G outputs a control signal to the control valve 37 so that the movement speed Vr of the regulation point RP of the bucket 8 reaches the restriction speed U corresponding to the operation distance Da. With this process, the movement speed of the regulation point RP of the bucket 8 decreases as the regulation point RP approaches the target construction shape CS (the tilting stop ground shape ST) and reaches zero when the regulation point RP (the tip 9) reaches the target construction shape CS.

In the present embodiment, the tilting operation plane TP is defined and the tilting stop ground shape ST which is the nodal line between the tilting operation plane TP and the target construction shape CS is derived. The working device control unit 51G executes tilting stop control so that the regulation point RP does not exceed the target construction shape CS based on the operation distance Da between the target construction shape CS and the regulation point RP which is the closest to the tilting stop ground shape ST among the plurality of candidate regulation points RPc. Since tilting stop control is executed based on the operation distance Da that is longer than the vertical distance Db, the tilting operation of the bucket 8 is suppressed from being stopped unnecessarily as compared to when the tilting stop control is executed based on the vertical distance Db. In the present embodiment, the position of the tilting stop ground shape ST does not change when the bucket 8 performs a tilting operation only. Therefore, an excavation operation using the bucket 8 which can perform a tilting operation is executed smoothly.

[Position of Tilting Stop Ground Shape ST]

Figure 18:
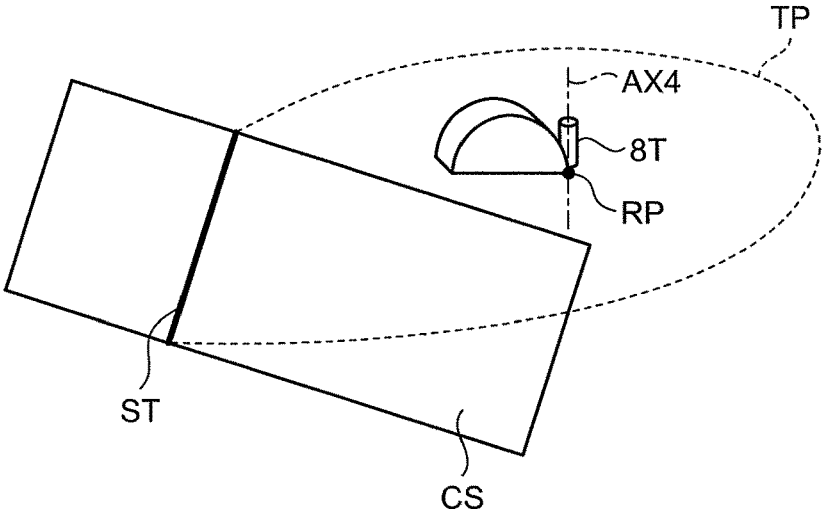
FIG. 18 is a diagram illustrating the position of a tilting stop ground shape.
Figure 19:
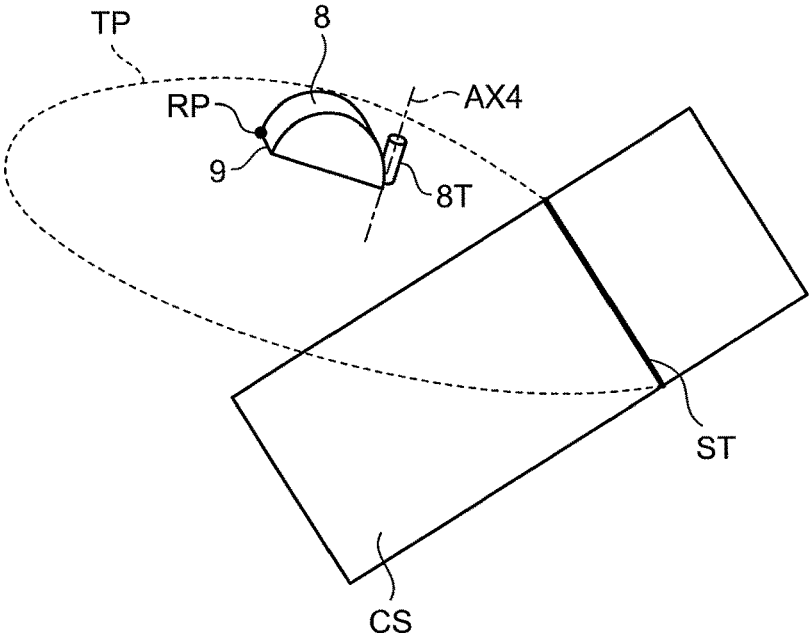
FIG. 19 is a diagram illustrating the position of a tilting stop ground shape.

FIGS. 18 and 19 are diagrams illustrating the position of the tilting stop ground shape ST. FIG. 18 illustrates an example in which the tilting operation plane TP and the target construction shape CS cross each other on the tip 9 side of the bucket 8. FIG. 19 illustrates an example in which the tilting operation plane TP and the target construction shape CS cross each other on the tilting pin 8T side of the bucket 8. When the bucket 8 performs a tilting operation, an operator may want to stop the tilting operation of the bucket 8 with respect to the target construction shape CS present on the tilting pin 8T side (that is, the backside) of the bucket 8 as well as the target construction shape CS present on the tip 9 side of the bucket 8.

When executing tilting stop control with respect to the target construction shape CS present on the tip 9 side of the bucket 8, the control device 50 stops the tilting operation of the bucket 8 based on the operation distance Da between the regulation point RP of the bucket 8 and the tilting stop ground shape ST present on the tip 9 side of the bucket 8. When executing tilting stop control with respect to the target construction shape CS present on the tilting pin 8T side of the bucket 8, the control device 50 stops the tilting operation of the bucket 8 based on the operation distance Da between the regulation point RP of the bucket 8 and the tilting stop ground shape ST present on the tilting pin 8T side of the bucket 8.

Figure 20:
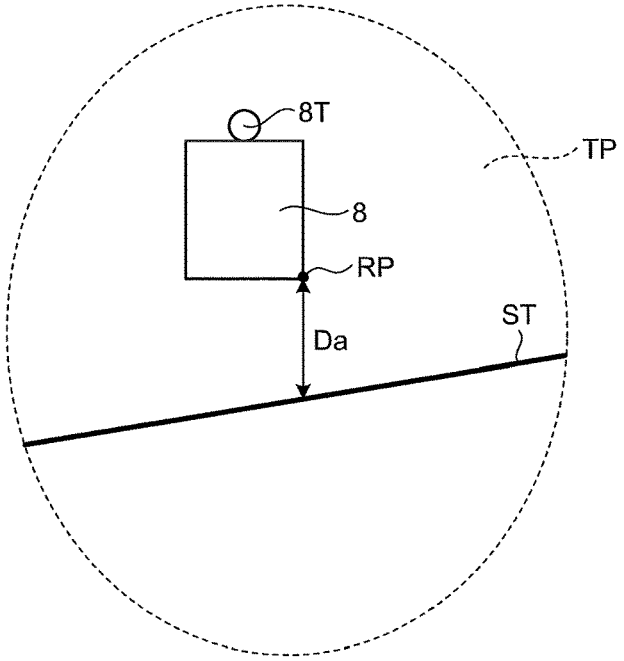
FIG. 20 is a diagram illustrating a state when a bucket and a tilting stop ground shape are seen on a tilting operation plane.
Figure 21:
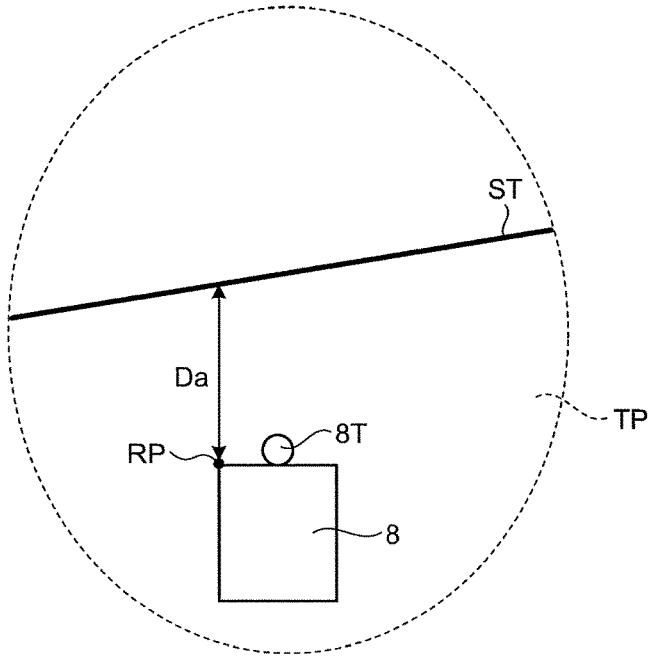
FIG. 21 is a diagram illustrating a state when a bucket and a tilting stop ground shape are seen on a tilting operation plane.

FIGS. 20 and 21 are diagrams illustrating a state when the bucket 8 and the tilting stop ground shape ST are seen on the tilting operation plane TP. FIGS. 20 and 21 illustrate a state when the bucket 8 is seen from the target construction shape CS and the direction parallel to the tilting pin 8T. FIG. 20 illustrates a case in which the tilting operation plane TP and the target construction shape CS cross each other on the tip 9 side of the bucket 8. In this case, when the bucket 8 and the tilting stop ground shape ST on the tilting operation plane TP are seen, since the bucket 8 is present on the upper side (that is, the air side) of the tilting stop ground shape ST, the control device 50 executes tilting stop control based on the operation distance Da between the bucket 8 and the tilting stop ground shape ST.

FIG. 21 illustrates a case in which the tilting operation plane TP and the target construction shape CS cross each other on the tilting pin 8T side of the bucket 8. In this case, as illustrated in FIG. 21, when the bucket 8 and the tilting stop ground shape ST on the tilting operation plane TP are seen, although the bucket 8 is present on the upper side of the tilting stop ground shape ST, the bucket 8 appears to be on the lower side (that is, inside the construction target) of the tilting stop ground shape ST. As a result, the bucket 8 appears to scoop into the tilting stop ground shape ST. Thus, since the control device 50 stops the tilting operation by misunderstanding that the bucket 8 scoops into the construction target, the tilting operation cannot be performed even if the bucket 8 is present on the air side and the tilting operation can be performed.

Figure 22:
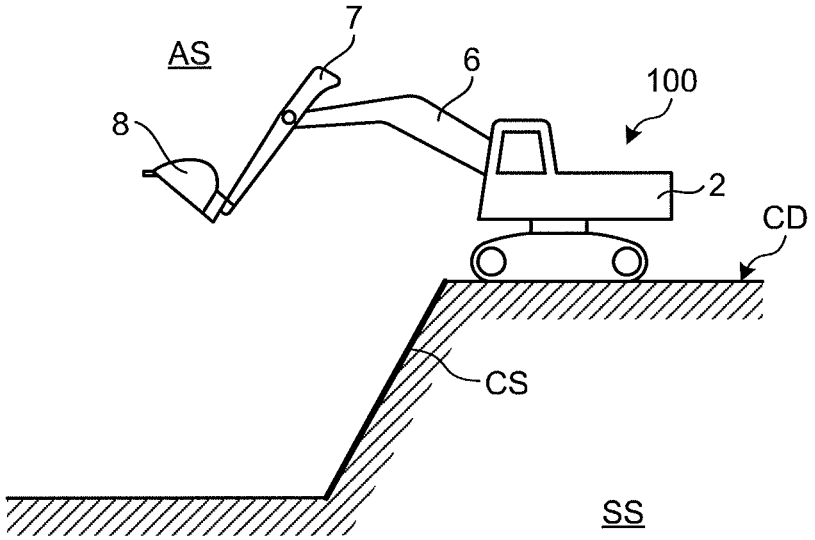
FIG. 22 is a diagram illustrating a positional relation between an air side and a ground side.

FIG. 22 is a diagram illustrating the positional relation between the air side AS and the ground side SS. The side on which the excavator 100 is present in relation to the target construction shape CS is referred to as the air side AS and the side on which the excavator 100 is not present is referred to as the ground side SS. Since the bucket 8, the arm 7, the boom 6, and the upper swinging body 2 are parts of the excavator 100, the side on which the bucket 8, the arm 7, the boom 6, and the upper swinging body 2 are present in relation to the target construction shape CS is the air side AS, and the side on which the bucket 8, the arm 7, the boom 6, and the upper swinging body 2 are not present is the ground side SS. Since the target construction shape CS is a portion of the target construction data CD, the air side AS is the side on which the excavator 100 is present in relation to the target construction data CD and the ground side SS is the side on which the excavator 100 is not present in relation to the target construction data CD.

When the bucket 8 is present on the air side AS, the control device 50 allows rotation (that is, a tilting operation) of the bucket 8. When the bucket 8 is not present on the air side AS (that is, present on the ground side SS), the control device 50 does not allow the tilting operation. When the bucket 8 is present on the air side AS, the control device 50 executes tilting stop control based on the operation distance Da between the bucket 8 and the tilting stop ground shape ST in order to allow the tilting operation of the bucket 8.

Figure 23:
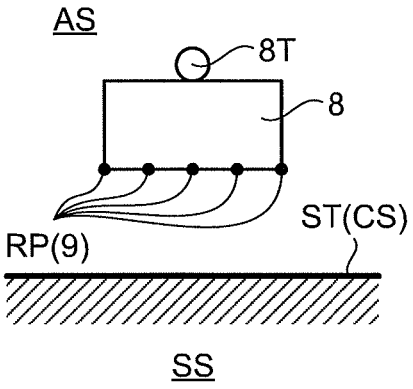
FIG. 23 is a diagram illustrating the relation between a bucket and a tilting stop ground shape and a target construction shape.
Figure 24:
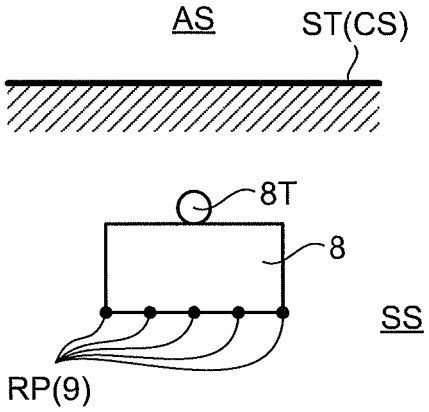
FIG. 24 is a diagram illustrating the relation between a bucket and a tilting stop ground shape and a target construction shape.
Figure 25:
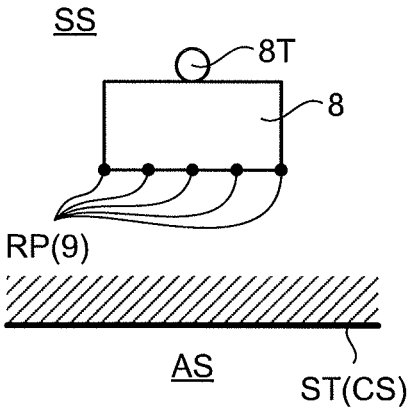
FIG. 25 is a diagram illustrating the relation between a bucket and a tilting stop ground shape and a target construction shape.

FIGS. 23 to 26 are diagrams illustrating the relation between the bucket 8 and the tilting stop ground shape ST and the target construction shape CS. FIGS. 23 and 25 illustrate a case in which the tilting operation plane TP and the target construction shape CS cross each other on the tip 9 side of the bucket 8. As illustrated in FIG. 23, when the tilting stop ground shape ST and the target construction shape CS face the regulation point RP set to the bucket 8, the bucket 8 is present on the air side AS. However, as illustrated in FIG. 25, even when the tilting stop ground shape ST and the target construction shape CS face the regulation point RP set to the bucket 8, the bucket 8 is not present on the air side AS but is present on the ground side SS.

Figure 26:
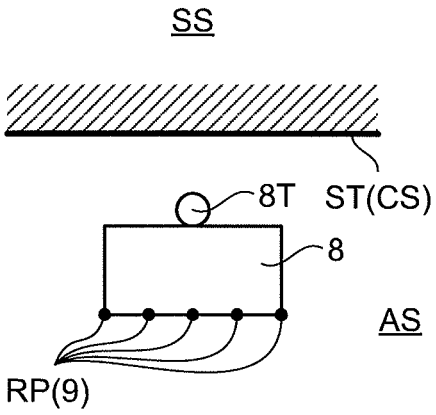
FIG. 26 is a diagram illustrating the relation between a bucket and a tilting stop ground shape and a target construction shape.

FIGS. 24 and 26 illustrate a case in which the tilting operation plane TP and the target construction shape CS cross each other on the tilting pin 8T side of the bucket 8. As illustrated in FIG. 24, when the tilting stop ground shape ST and the target construction shape CS face the tilting pin 8T side of the bucket 8, the bucket 8 is not present on the air side AS but is present on the ground side SS. However, as illustrated in FIG. 26, even when the tilting stop ground shape ST and the target construction shape CS face the tilting pin 8T side of the bucket 8, the bucket 8 is present on the air side AS.

Even when the tilting operation plane TP and the target construction shape CS cross each other on the tip 9 side of the bucket 8 and the tilting operation plane TP and the target construction shape CS cross each other on the tilting pin 8T side of the bucket 8, the control device 50 allows the tilting operation when the bucket 8 is present on the air side AS. The control device 50 does not allow the tilting operation when the bucket 8 is not present on the air side AS (that is, present on the ground side SS).

[Process of Determining Whether Bucket is on Air Side AS or Ground Side SS]

Figure 27:
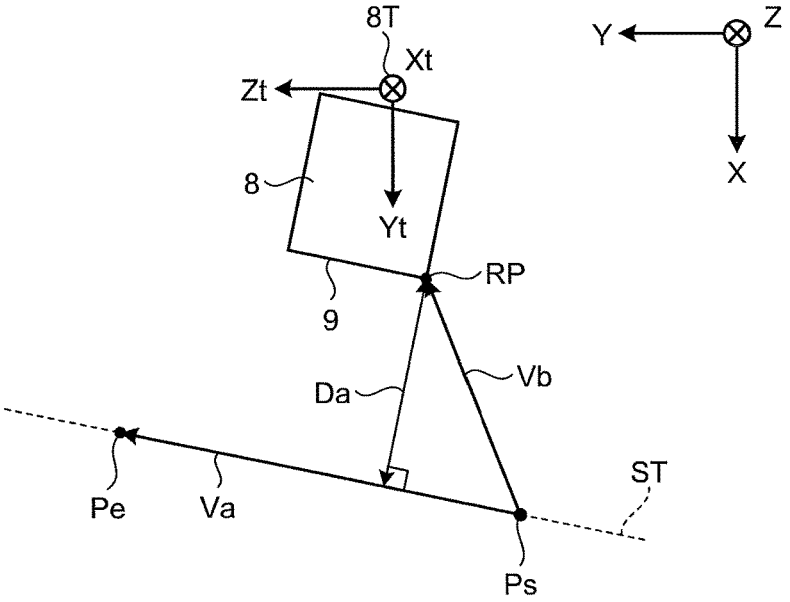
FIG. 27 is a diagram for describing a method of calculating an operation distance between a bucket and a tilting stop ground shape and determining whether a tilting operation plane and a target construction shape cross any one of a tip side and a tilting pin side.
Figure 28:
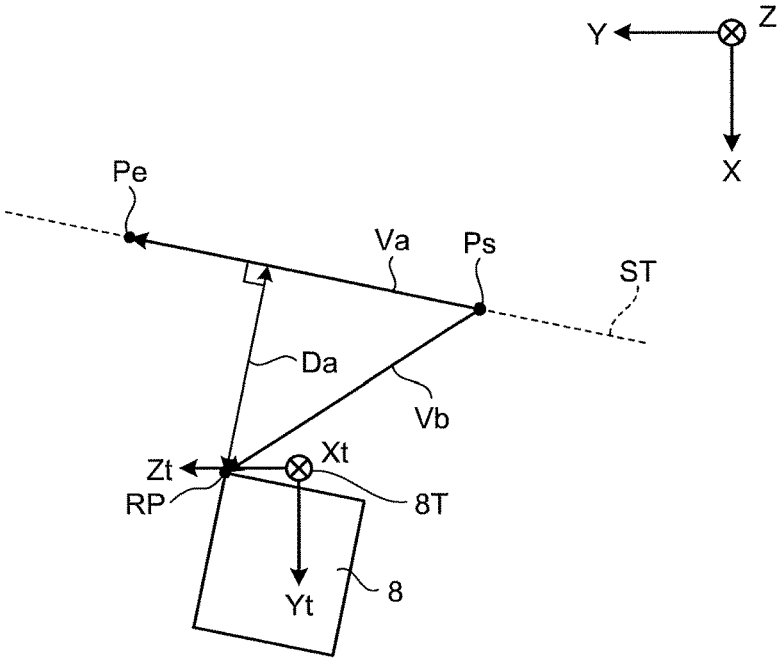
FIG. 28 is a diagram for describing a method of calculating an operation distance between a bucket and a tilting stop ground shape and determining whether a tilting operation plane and a target construction shape cross any one of a tip side and a tilting pin side.

FIGS. 27 and 28 are diagrams for describing a method of calculating the operation distance Da between the bucket 8 and the tilting stop ground shape ST and determining whether the tilting operation plane TP and the target construction shape CS cross each other on the tip 9 side or the tilting pin 8T side of the bucket 8. FIGS. 29, 30, 31, and 32 are diagrams illustrating a method of determining whether the bucket 8 is present on the air side AS side or the ground side SS side even when the tilting operation plane TP and the target construction shape CS cross each other on the tip 9 side or the tilting pin 8T side of the bucket 8. When determining whether the bucket 8 is present on the air side AS side or the ground side SS side, the control device 50 calculates the operation distance Da which is the distance between the bucket 8 and the tilting stop ground shape ST. In the present embodiment, the operation distance Da is obtained by the restriction speed determination unit 51H.

The restriction speed determination unit 51H calculates the operation distance Da in a tilting pin coordinate system (Xt-Yt-Zt). The tilting pin coordinate system (Xt-Yt-Zt) is defined such that the tilting shaft AX4 of the tilting pin 8T is the Xt-axis, and the two axes orthogonal to the Xt-axis are Yt and Zt-axes. The Yt-axis and the Zt-axis are orthogonal to each other. The Yt-axis is an axis parallel to the XZ plane of the vehicle body coordinate system (X-Y-Z). The Yt-axis rotates in the XZ plane of the vehicle body coordinate system (X-Y-Z) together with the Xt-axis when the tilting pin 8T rotates about the bucket shaft AX3.

The restriction speed determination unit 51H calculates a vector Va that connects a starting point Ps and an ending point Pe which are arbitrary two points on the tilting stop ground shape ST and a vector Vb that connects the starting point Ps on the tilting stop ground shape ST and the regulation point RP of the bucket 8. In the example illustrated in FIG. 27, the regulation point RP is a portion of the tip 9, and in the example of FIG. 28, the regulation point RP is a portion of the bucket 8 on the tilting pin 8T side.

The vector Va is a vector directed from the starting point Ps toward the ending point Pe. The vector Vb is a vector directed from the starting point Ps toward the regulation point RP. The operation distance Da can be calculated by Expression (1) using the vectors Va and Vb. In Expression (1), Va×Vb is an outer product between the vectors Va and Vb. "x" on the right side of Expression (1) means that the operation distance Da is an X-direction component of the vehicle body coordinate system (X-Y-Z).

$$Da=[Va\times Vb/|Va|]x \tag{1}$$

The operation distance Da is a distance with a sign indicating positive or negative. From Expression (1), since the operation distance Da can be calculated by the outer product between the vectors Va and Vb, the direction of Va×Vb is inverted depending on the position of the vector Vb in relation to the vector Va. For example, when the direction of Va×Vb in the state illustrated in FIG. 27 is a first direction, the direction of Va×Vb in the state illustrated in FIG. 28 is a direction rotated by 180° from the first direction. When the sign of the operation distance Da in the first direction is positive (+), the sign of the operation distance Da in the second direction is negative (−). The sign of the operation distance Da is not limited to the definition illustrated in the present embodiment.

When the direction of Va×Vb is the first direction (that is, the sign of the operation distance Da is positive), the tilting operation plane TP and the target construction shape CS cross each other on the tip 9 side of the bucket 8. When the direction of Va×Vb is the second direction (that is, the sign of the operation distance Da is negative), the tilting operation plane TP and the target construction shape CS cross each other on the tilting pin 8T side of the bucket 8.

The control device 50 calculates the operation distance Da and determines whether the tilting operation plane TP and the target construction shape CS cross each other on the tip 9 side or the tilting pin 8T side of the bucket 8. From these items of information, the control device 50 determines whether the bucket 8 is on the air side AS or the ground side SS (that is, whether the bucket 8 scoops into the target construction shape CS or not). A determination unit 50J of the control device 50 calculates Vn×N which is an outer product between a first vector Vn extending in a direction orthogonal to the target construction shape CS and a second vector N extending in an extension direction of the tilting shaft AX4. The first vector Vn is a vector directed from the target construction shape CS toward the air side AS. The second vector N is a vector directed from a first end 8TF of the tilting pin 8T toward a second end 8TS. The first end 8TF of the tilting pin 8T is present in the extension direction of the tilting pin 8T and is an end on an opening 8HL side of the bucket 8. The second end 8TS is present in the extension direction of the tilting pin 8T and is an end on the opposite side of the first end 8TF. The outer product between the first and second vectors Vn and N is obtained in the vehicle body coordinate system (X-Y-Z).

Figure 29:
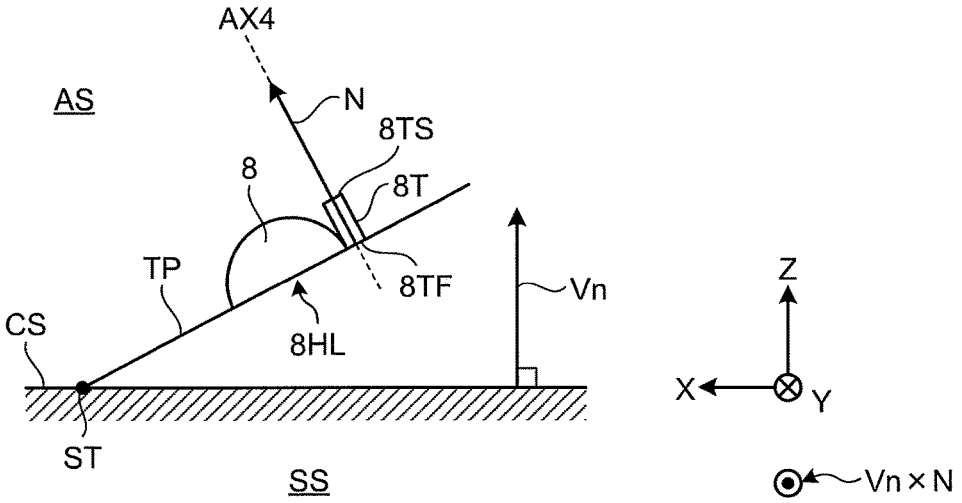
FIG. 29 is a diagram illustrating a method of determining whether a bucket is present on an air side or a ground side even when a tilting operation plane and a target construction shape cross each other on a tip side or a tilting pin side of the bucket.
Figure 30:
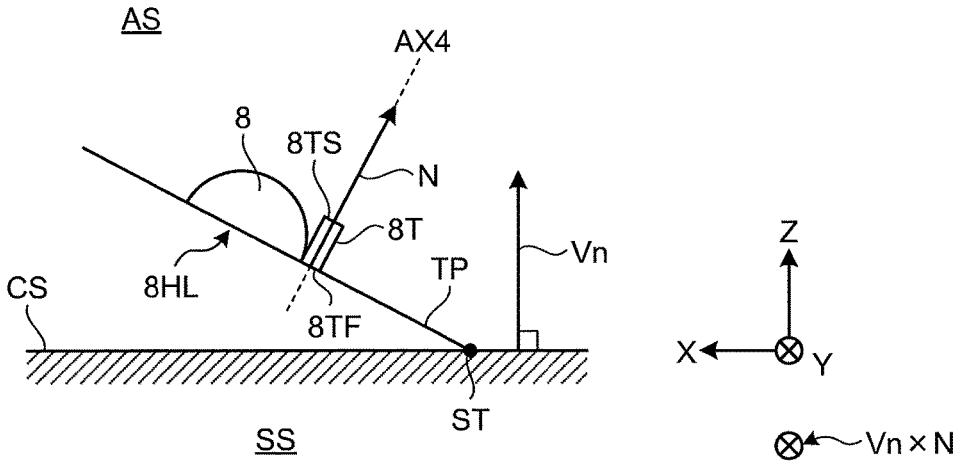
FIG. 30 is a diagram illustrating a method of determining whether a bucket is present on an air side or a ground side even when a tilting operation plane and a target construction shape cross each other on a tip side or a tilting pin side of the bucket.
Figure 31:
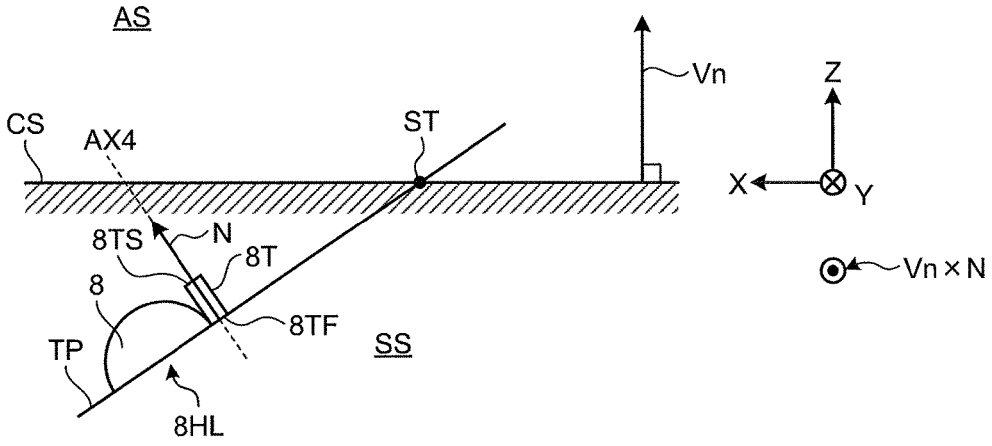
FIG. 31 is a diagram illustrating a method of determining whether a bucket is present on an air side or a ground side even when a tilting operation plane and a target construction shape cross each other on a tip side or a tilting pin side of the bucket.
Figure 32:
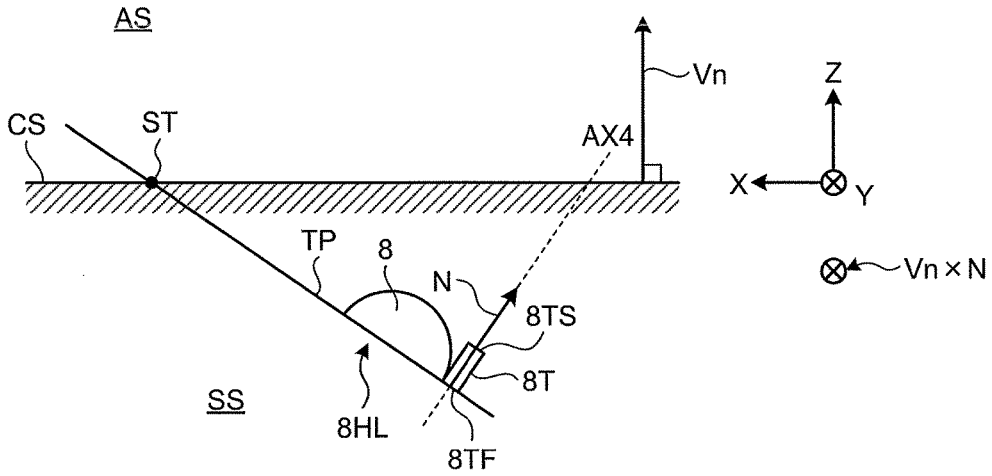
FIG. 32 is a diagram illustrating a method of determining whether a bucket is present on an air side or a ground side even when a tilting operation plane and a target construction shape cross each other on a tip side or a tilting pin side of the bucket.

The direction of Vn×N which is the outer product between the first and second vectors Vn and N is inverted depending on the position of the second vector N in relation to the first vector Vn. For example, when the direction of the outer product Vn×N in the state illustrated in FIGS. 29 and 31 is defined as a first direction, the direction of the outer product Vn×N in the state illustrated in FIGS. 30 and 32 is a direction (that is, the second direction) rotated by 180° from the first direction. When the sign of the outer product Vn×N in the first direction is positive (+), the sign of the outer product Vn×N in the second direction is negative (−). The sign of the outer product Vn×N is not limited to the definition illustrated in the present embodiment.

The determination unit 51J maintains the sign of the operation distance Da to the value calculated by the restriction speed determination unit 51H when the direction of the outer product Vn×N is a predetermined direction (in the present embodiment, the first direction). In the example illustrated in FIGS. 29 and 31, the determination unit 51J receives the operation distance Da from the restriction speed determination unit 51H and outputs the operation distance Da in a state in which the sign is maintained (that is, a state in which the sign is not inverted). In the present embodiment, although the determination unit 51J outputs the operation distance Da to the working device control unit 51G, an output destination of the operation distance Da is not limited.

In this case, when the sign of the operation distance Da is positive, the bucket 8 is present on the air side AS as illustrated in FIG. 29. When the sign of the operation distance Da is negative, the bucket 8 is present on the ground side SS as illustrated in FIG. 31.

When the direction of the outer product Vn×N is not the predetermined direction (in the present embodiment, the second direction), the determination unit 51J inverts the sign of the operation distance Da from the value calculated by the restriction speed determination unit 51H and outputs the inverted sign. In the example illustrated in FIGS. 30 and 32, the determination unit 51J receives the operation distance Da from the restriction speed determination unit 51H and outputs the operation distance Da with the sign inverted.

When the direction of the outer product Vn×N is not the predetermined direction, the bucket 8 is present on the ground side SS as illustrated in FIG. 32 if the sign of the operation distance Da is positive, and the bucket 8 is present on the air side AS as illustrated in FIG. 30 if the sign of the operation distance Da is negative. In this case, when the sign of the operation distance Da is inverted, the bucket 8 is present on the air side AS if the sign of the operation distance Da is positive, and the bucket 8 is present on the ground side SS if the sign of the operation distance Da is negative. That is, even when the tilting operation plane TP and the target construction shape CS cross each other on the tip 9 side of the bucket 8 and even when the tilting operation plane TP and the target construction shape CS cross each other on the tilting pin 8T side of the bucket 8, it is determined whether the bucket 8 is present on the air side AS or the ground side SS.

In the present embodiment, the determination unit 51J outputs the first information when the bucket 8 is present on the air side AS which is the side on which the excavator 100 is present in relation to the target construction shape CS and outputs the second information when the bucket 8 is not present on the air side AS. Specifically, as described above, the determination unit 51J outputs the first information or the second information using the operation distance Da which is the distance between the tilting stop ground shape ST and the regulation point RP, the first vector Vn extending in the direction orthogonal to the target construction shape CS, and the second vector N extending in the extension direction of the tilting shaft AX4 which is the shaft line. The working device control unit 51G allows rotation (that is, a tilting operation) of the bucket 8 when the first information is output from the determination unit 51J and does not allow rotation of the bucket 8 when the second information is output.

With this process, the control system 200 and the control device 50 can properly determine whether the bucket 8 is present on the air side AS or the ground side SS (that is, the bucket 8 scoops into the target construction shape CS or not) regardless of the positional relation between the bucket 8 and the tilting stop ground shape ST and the target construction shape CS. As a result, the control system 200 and the control device 50 can execute tilting stop control with respect to both the target construction shape CS present on the tip 9 side of the bucket 8 and the target construction shape CS present on the tilting pin 8T side of the bucket 8 to thereby stop the tilting operation of the bucket 8. Moreover, the control system 200 and the control device 50 can stop the tilting operation when the bucket 8 scoops into the target construction shape CS present on the tip 9 side of the bucket 8 and the target construction shape CS present on the tilting pin 8T side of the bucket 8. In this way, the control system 200 and the control device 50 can reduce restrictions on the control based on the attitude of the bucket 8 of the excavator 100 and the positional relation between the bucket 8 and the target construction shape CS when controlling the operation of the bucket 8 so as not to enter the target construction shape CS.

[Control Method]

Figure 33:
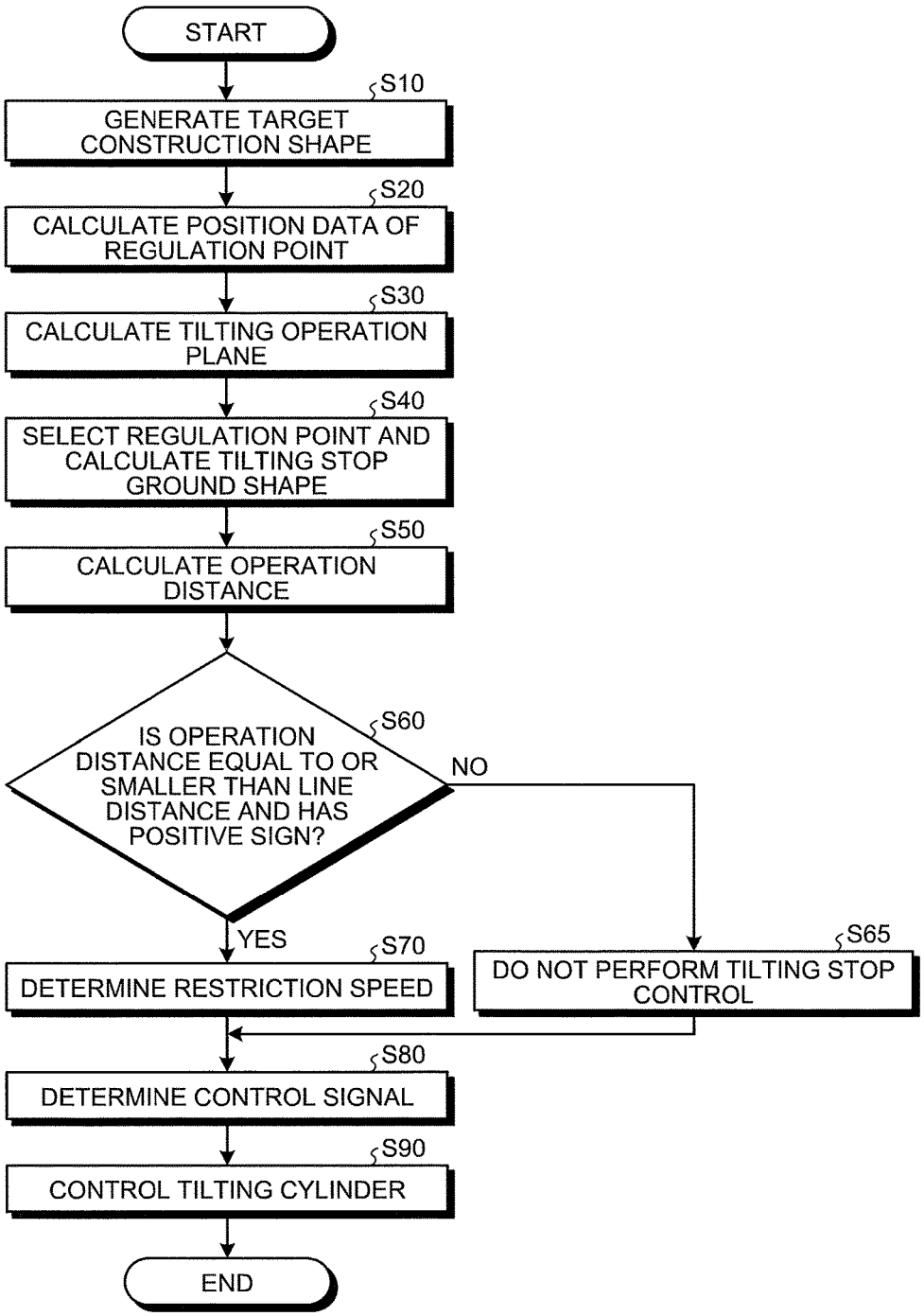
FIG. 33 is a flowchart illustrating an example of a work machine control method according to the present embodiment.

FIG. 33 is a flowchart illustrating an example of a work machine control method according to the present embodiment. The target construction shape generation unit 51D generates the target construction shape CS based on the lines LX and LY which are the target construction data supplied from the target construction data generation device 70 (step S10).

The candidate regulation point position data calculation unit 51Ca calculates the position data of each of the plurality of regulation points RP set to the bucket 8 based on the working device angle data acquired by the working device angle data acquisition unit 51B and the working device data stored in the storage unit 52 (step S20).

The operation plane calculation unit 51E calculates the tilting operation plane TP which passes through the regulation point RP and is orthogonal to the tilting shaft AX4 (step S30). The stop ground shape calculation unit 51F selects the regulation point RP which is best useful for controlling the tilting bucket from the plurality of candidate regulation points RPc and calculates the tilting stop ground shape ST in which the target construction shape CS and the tilting operation plane TP cross each other (step S40). The restriction speed determination unit 51H calculates the operation distance Da between the regulation point RP and the tilting stop ground shape ST (step S50). Next, a process of calculating the operation distance Da will be described.

Figure 34:
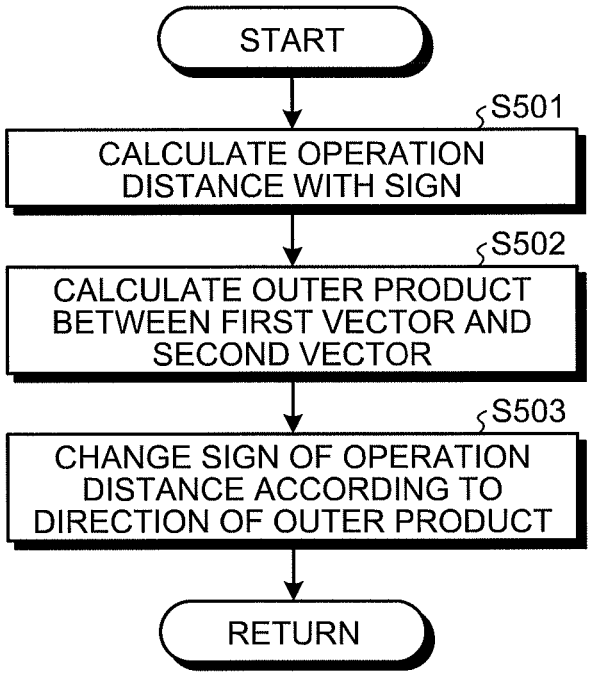
FIG. 34 is a flowchart illustrating a process when calculating an operation distance in a work machine control method according to the present embodiment.

FIG. 34 is a flowchart illustrating a process of calculating the operation distance Da in the work machine control method according to the present embodiment. In step S501, the restriction speed determination unit 51H calculates the signed operation distance Da which is the distance between the regulation point RP and the tilting stop ground shape ST. In step S502, the determination unit 51J calculates the outer product Vn×N between the first vector Vn and the second vector N. In step S503, the determination unit 51J inverts the sign of the operation distance Da according to the direction (that is, the sign) of the outer product Vn×N and outputs the operation distance Da to the working device control unit 51G.

In step S60, when the absolute value of the operation distance Da is equal to or smaller than the line distance H and the sign of the operation distance Da is positive (step S60: Yes), the restriction speed determination unit 51H determines the restriction speed U corresponding to the absolute value of the operation distance Da (step S70).

The working device control unit 51G determines the control signal for the control valve 37 based on the movement speed Vr of the regulation point RP of the bucket 8 calculated from the operation amount of the tilting manipulation lever 30T and the restriction speed U determined by the restriction speed determination unit 51H (step S80). The working device control unit 51G outputs the control signal to the control valve 37. The control valve 37 controls the pilot pressure based on the control signal output from the working device control unit 51G. In this way, since the tilting cylinder 14 is controlled (step S90), the movement speed Vr of the regulation point RP of the bucket 8 is limited. When the bucket 8 performing a tilting operation approaches the target construction shape CS and the absolute value of the operation distance Da reaches zero, the tilting operation of the bucket 8 stops.

In step S60, when the absolute value of the operation distance Da is larger than the line distance H and the sign thereof is negative, when the absolute value of the operation distance Da is larger than the line distance H and the sign thereof is positive, or when the absolute value of the operation distance Da is equal to or smaller than the line distance H and the sign thereof is negative (step S60: No), the control device 50 does not perform tilting stop control (step S65). In this case, in step S80, the working device control unit 51G generates a control signal for changing the movement speed of the regulation point RP of the bucket 8 to a movement speed Vr calculated from the operation amount of the tilting manipulation lever 30T and outputs the control signal to the control valve 37. In this way, the tilting cylinder 14 is controlled so that the regulation point RP of the bucket 8 moves at the movement speed Vr (step S90).

With this process, the control system 200 and the control device 50 can properly determine whether the bucket 8 scoops into the target construction shape CS or not regardless of the positional relation between the bucket 8 and the tilting stop ground shape ST and the target construction shape CS. Due to this, the control system 200 and the control device 50 can execute tilting stop control with respect to both the target construction shape CS present on the tip 9 side of the bucket 8 and the target construction shape CS present on the tilting pin 8T side of the bucket 8 to stop the tilting operation of the bucket 8.

[When Plural Target Construction Shapes CS are Present]

Figure 35:
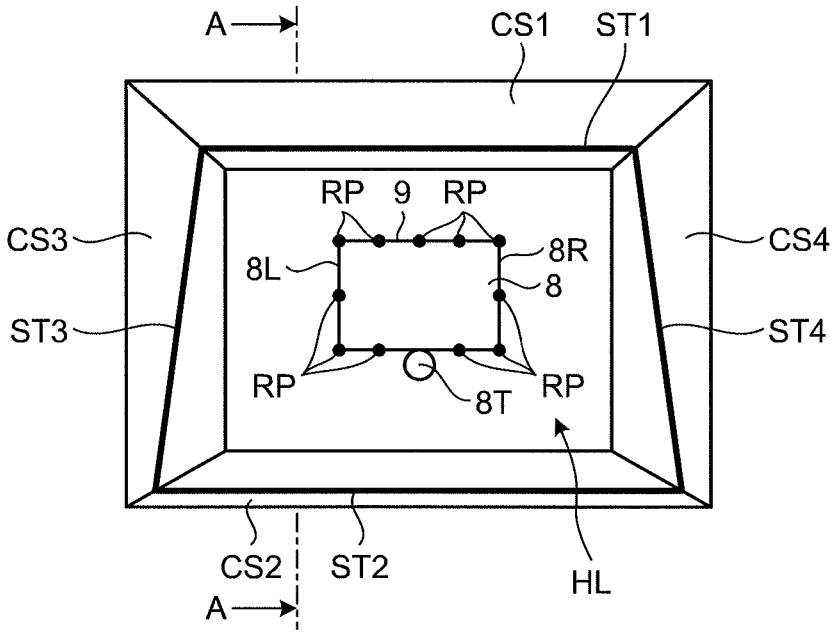
FIG. 35 is a plan view illustrating an example when a plurality of target construction shapes is present around a bucket.
Figure 36:
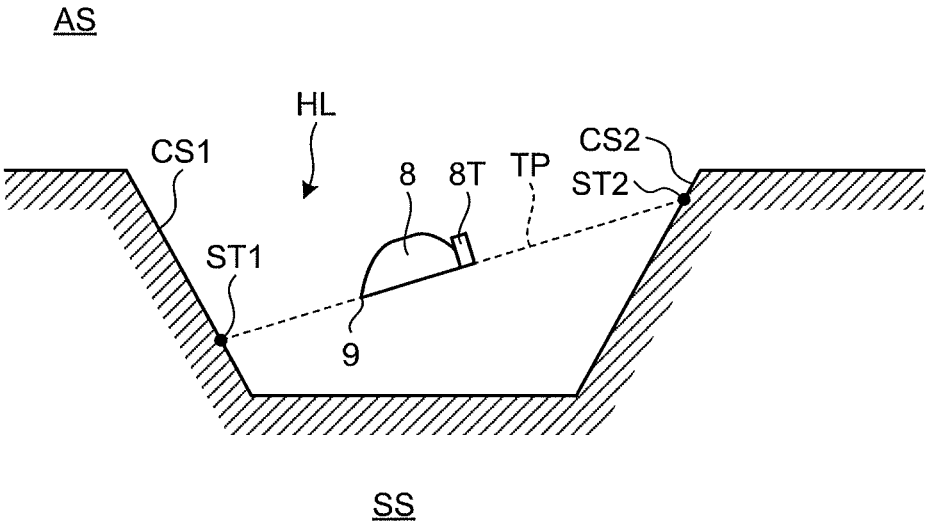
FIG. 36 is a view along arrow A-A in FIG. 35.

FIG. 35 is a plan view illustrating an example when a plurality of target construction shapes CS1, CS2, CS3, and CS4 is present around the bucket 8. FIG. 36 is a view along arrow A-A in FIG. 35. When a hole HL is excavated by the bucket 8, the target construction shape generation unit 51D of the control device 50 generates a plurality of target construction shapes CS1, CS2, CS3, and CS4 around the bucket 8. In this case, a plurality of target construction shapes CS1, CS2, CS3, and CS4 is present around the bucket 8 in construction.

The restriction speed determination unit 51H calculates an operation distance Da which is the distance between the regulation point RP of the bucket 8 and each of the target construction shapes CS1, CS2, CS3, and CS4. In this case, the restriction speed determination unit 51H selects an appropriate regulation point RP according to the position of each of the target construction shapes CS1, CS2, CS3, and CS4 and calculates the operation distance Da. For example, the restriction speed determination unit 51H uses the regulation point RP close to the tip 9 for the target construction shape CS1, the regulation point RP close to the tilting pin 8T for the target construction shape CS2, the regulation point RP close to a first side surface 8L for the target construction shape CS3, and the regulation point RP close to a second side surface 8R for the target construction shape CS4.

The restriction speed determination unit 51H calculates the operation distance Da of the target construction shape CS3 using the tilting stop ground shape ST which is a portion in which the tilting operation plane TP and the target construction shape CS cross each other and the regulation point RP close to the first side surface 8L. Moreover, the restriction speed determination unit 51H calculates the operation distance Da of the target construction shape CS4 using the tilting stop ground shape ST which is a portion in which the tilting operation plane TP and the target construction shape CS cross each other and the regulation point RP close to the second side surface 8R.

The determination unit 51J outputs the first information or the second information (that is, a signed operation distance Da) for each of the plurality of target construction shapes CS1, CS2, CS3, and CS4. In this case, the hole HL side in relation to the target construction shapes CS1, CS2, CS3, and CS4 is the air side AS and the opposite side of the hole HL is the ground side SS.

Since the first information or the second information is output for the plurality of target construction shapes CS1, CS2, CS3, and CS4 present around the bucket 8, the control system 200 and the control device 50 can properly determine whether the bucket 8 is present on the air side AS or the ground side SS (that is, the bucket 8 scoops into the target construction shape CS or not) regardless of the positional relation between the bucket 8 and the tilting stop ground shape ST and the target construction shape CS. As a result, the control system 200 and the control device 50 can execute tilting stop control with respect to the target construction shapes CS present around the bucket 8 and stop the tilting operation of the bucket 8.

[Example in which Member Rotating about Shaft Line is not Bucket 8]

Figure 37:
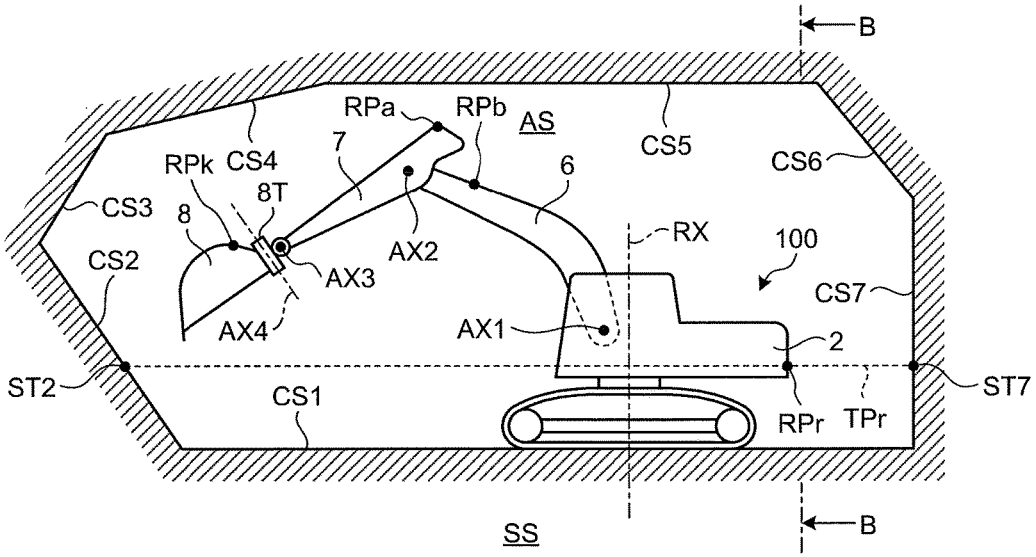
FIG. 37 is a diagram for describing an example when a member that rotates about an axial line is not a bucket.
Figure 38:
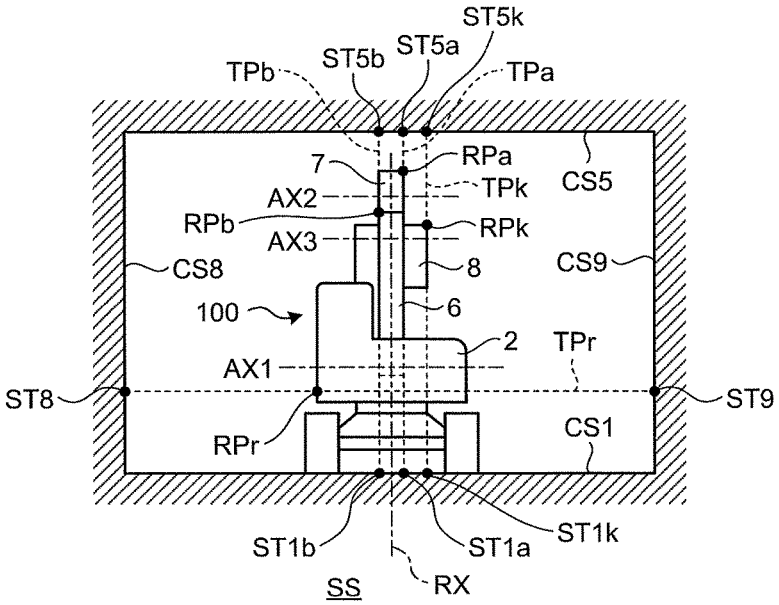
FIG. 38 is a view along arrow B-B in FIG. 37.

FIG. 37 is a diagram for describing an example in which a member that rotates about the shaft line is not the bucket 8. FIG. 38 is a view along arrow B-B in FIG. 37. FIGS. 37 and 38 illustrate a state in which the excavator 100 performs construction in a closed space. In this case, a plurality of target construction shapes CS1, CS2, CS3, CS4, CS5, CS6, CS7, CS8, and CS9 is present around the excavator 100. In the example illustrated in FIGS. 37 and 38, the inner side in relation to a portion surrounded by the plurality of target construction shapes CS1, CS2, CS3, CS4, CS5, CS6, CS7, CS8, and CS9 is the air side AS and the outer side is the ground side SS.

In the above-described example, although the member that rotates about the shaft line is the bucket 8 and the shaft line is the tilting shaft AX4, the member that rotates about the shaft line is not limited to the bucket 8. For example, the shaft line may be the boom shaft AX1 and the member that rotates about the shaft line may be the boom 6. The shaft line may be the arm shaft AX2 and the member that rotates about the shaft line may be the arm 7. The shaft line may be the swing axis RX and the member that rotates about the shaft line may be the upper swinging body 2. Moreover, when the member is the bucket 8, the shaft line may be the bucket shaft AX3. In this manner, in the present embodiment, the member that rotates about the shaft line may be at least one of the bucket 8, the arm 7, the boom 6, and the upper swinging body 2.

When the shaft line is the boom shaft AX1 and the member that rotates about the shaft line is the boom 6, a plane which is orthogonal to the boom shaft AX1 and passes through the regulation point RPb of the boom 6 is an operation plane TPb. A portion in which the operation plane TPb crosses at least one of the target construction shapes CS1, CS2, CS3, CS4, CS5, CS6, CS7, CS8, and CS9 is stop ground shapes ST1*b*, ST5*b*, and the like. The determination unit 51J outputs the first information or the second information (that is, a signed operation distance Da) using the distance between the regulation point RPb and each of the stop ground shapes ST1*b*, ST5*b*, and the like, the first vector which is orthogonal to the target construction shapes CS1, CS5, and the like and extends in a direction from the ground side SS toward the air side AS, and a second vector extending in an extension direction of the boom shaft AX1. The control device 50 executes stop control of stopping the boom 6 based on the signed operation distance Da.

When the shaft line is the arm shaft AX2 and the member that rotates about the shaft line is the arm 7, a plane which is orthogonal to the arm shaft AX2 and passes through the regulation point RPa of the arm 7 is an operation plane TPa. A portion in which the operation plane TPa crosses at least one of the target construction shapes CS1, CS2, CS3, CS4, CS5, CS6, CS7, CS8, and CS9 is stop ground shapes ST1*a*, ST5*a*, and the like. The determination unit 51J outputs the first information or the second information (that is, a signed operation distance Da) using the distance between the regulation point RPa and each of the stop ground shapes ST1*a*, ST5*a*, and the like, the first vector which is orthogonal to the target construction shapes CS1, CS5, and the like and extends in a direction from the ground side SS toward the air side AS, and the second vector extending in an extension direction of the arm shaft AX2. The control device 50 executes stop control of stopping the arm 7 based on the signed operation distance Da.

When the shaft line is the swing axis RX and the member that rotates about the shaft line is the upper swinging body 2, a plane which is orthogonal to the swing axis RX and passes through the regulation point RPr of the upper swinging body 2 is an operation plane TPr. A portion in which the operation plane TPr crosses at least one of the plurality of target construction shapes CS1, CS2, CS3, CS4, CS5, CS6, CS7, CS8, and CS9 is stop ground shapes ST2, ST7, ST8, ST9, and the like. The determination unit 51J outputs the first information or the second information (that is, a signed operation distance Da) using the distance between the regulation point RPr and each of the stop ground shapes ST2, ST7, ST8, ST9, and the like, the first vector which is orthogonal to the target construction shapes CS2, CS7, CS8, CS9, and the like and extends in a direction from the ground side SS toward the air side AS, and the second vector extending in an extension direction of the swing axis RX. The control device 50 executes stop control of stopping the upper swinging body 2 based on the signed operation distance Da.

When the shaft line is the bucket shaft AX3 and the member is the bucket 8, a plane which is orthogonal to the bucket shaft AX3 and passes through the regulation point RPk of the bucket 8 is an operation plane TPk. A portion in which the operation plane TPk crosses at least one of the plurality of target construction shapes CS1, CS2, CS3, CS4, CS5, CS6, CS7, CS8, and CS9 is stop ground shapes ST1*k*, ST5*k*, and the like. The determination unit 51J outputs the first information or the second information (that is, a signed operation distance Da) using the distance between the regulation point RPk and each of the stop ground shapes ST1*k*, ST5*k*, and the like, the first vector extending in a direction orthogonal to the target construction shapes CS1, CS5, and the like, and the first vector extending in an extension direction of the bucket shaft AX3. The control device 50 executes stop control of stopping the bucket 8 based on the signed operation distance Da.

In this manner, in the present embodiment, the control system 200 and the control device 50 can control an operation of a member other than the bucket 8 based on the first information or the second information. Therefore, the control system 200 and the control device 50 can properly determine whether the member of the excavator 100 scoops into the target construction shape CS or not regardless of the positional relation between the member and each of the stop ground shapes ST5*b*, ST5*a*, ST5*k*, ST2, and the like. Due to this, the control system 200 and the control device 50 can execute stop control with respect to the target construction shapes CS present around the member and stops the tilting operation of the bucket 8. As a result, the control system 200 and the control device 50 can reduce restrictions on the control based on the attitude of the member of the excavator 100 and the positional relation between the member of the excavator 100 and the target construction shape CS when controlling the operation of the member so as not to enter the target construction shape CS.

In the present embodiment, the determination unit 51J determines whether at least one member of the excavator 100 is present on the air side AS or the ground side SS using the distance between the stop ground shape and the regulation point, the first vector Vn extending in a direction orthogonal to the target construction shape CS, and the second vector N extending in the extension direction of the shaft line. A method of determining whether the member is present on the air side AS or the ground side SS is not limited to this. For example, the determination unit 51J may determine whether the member is present on the air side AS or the ground side SS from a positional relation between at least one member of the excavator 100 and the construction target obtained by capturing an image of the member.

Figure 39:
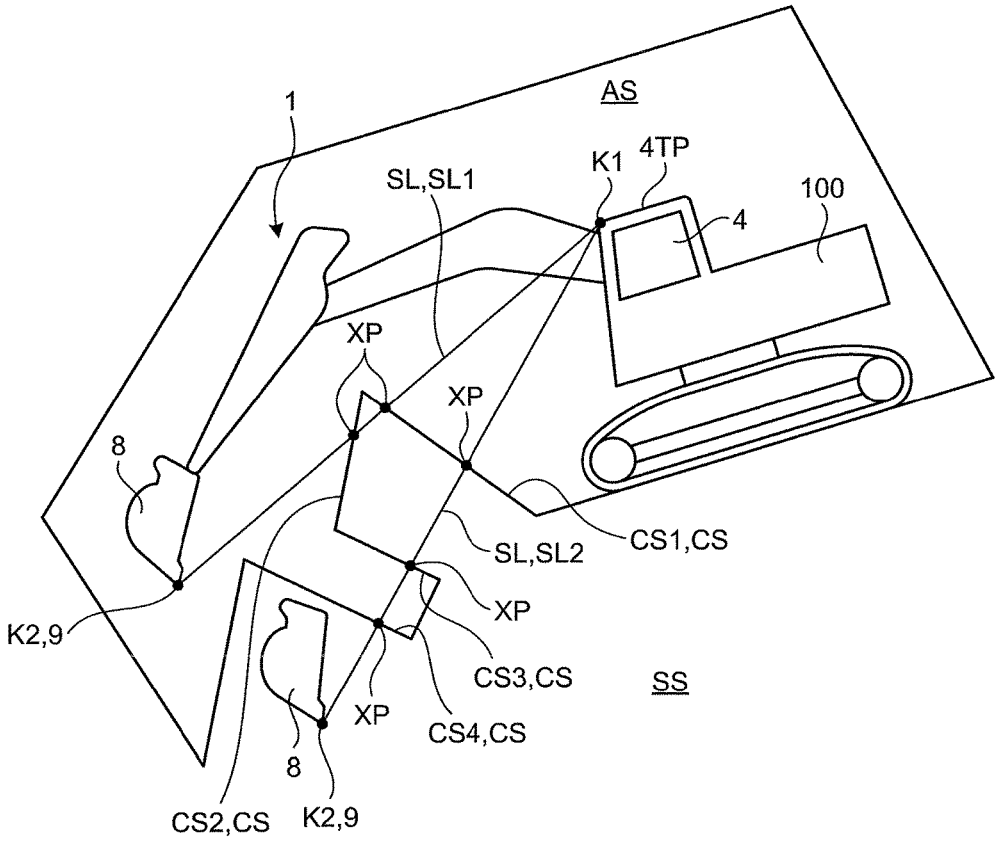
FIG. 39 is a diagram for describing another method of determining whether a member is present on an air side or a ground side.

FIG. 39 is a diagram for describing another method of determining whether the member is present on the air side AS or the ground side SS. In the excavator 100, a known position which is definitely present on the air side AS is defined as a first position K1. The first position K1 is set to a roof 4TP of the cab 4, for example. The first position K1 is located at a position of a portion different from the member of the excavator 100, which an operator wants to determine whether the member is present on the air side AS or the ground side SS and is a known reference point.

The position of the member which the operator wants to determine whether the member is present on the air side AS or the ground side SS is defined as a second position K2. The second position K2 is set to a portion of the tip 9 of the bucket 8, for example. A line segment that connects the first position K1 and the second position K2 is a determination line SL. The second position K2 is one of the regulation points RP. The second position K2 is calculated by the candidate regulation point RP position data calculation unit 51Ca.

The determination unit 51J calculates the determination line SL from the first position K1 and the second position K2 obtained from the attitude of the working device 1. The determination line SL is a line segment that connects the first and second positions K1 and K2. The determination unit 51J calculates the number of intersections XP between the determination line SL and the target construction shape CS and determines whether the second position K2 is present on the air side AS or the ground side SS based on the number of intersections XP. Specifically, the determination unit 51J determines that the second position K2 is present on the air side AS when the number of intersections XP is an even number and determines that the second position K2 is present on the ground side SS when the number of intersections XP is an odd number. Specifically, since a determination line SL1 has two intersections XP, the determination unit 51J determines that the second position K2 is present on the air side AS and outputs the first information. Since a determination line SL2 has three intersections XP, the determination unit 51J determines that the second position K2 is present on the ground side SS and outputs the second information. That is, the determination unit 51J outputs the first information or the second information depending on whether the number of intersections XP is an even number or an odd number.

In the present embodiment, although the work machine is an excavator, the constituent elements described in the embodiment may be applied to a work machine having a working device, different from the excavator. Moreover, although the working device control unit 51G controls the working device 1 based on the first information and the second information output by the determination unit 51J, the present invention is not limited to this. The items of the first and second information output by the determination unit 51J or information based on these items of information may be displayed on a monitor in the cab 4 illustrated in FIG. 1 or be notified from a speaker. For example, since the first information is information indicating that the member is present on the air side AS, information indicating that an operation of the member is allowed is displayed on a monitor and notified by a speaker. Moreover, since the second information is information indicating that the member is present on the ground side SS, information indicating that an operation of the member is not allowed is displayed on a monitor and notified by a speaker.

In the present embodiment, although the operation distance Da having the positive sign output from the determination unit 51J or the information indicating that the number of intersections is an even number is used as the first information and the operation distance Da having the negative sign output from the determination unit 51J or the information indicating that the number of intersections is an odd number is used as the second information, the first and second information is not limited to this. For example, the determination unit 51J may output 0 or Low signal when the sign of the operation distance Da is positive and may output 1 or High signal when the sign of the operation distance Da is negative. In this case, 0 or Low signal is the first information and 1 or High signal is the second information. Moreover, the determination unit 51J may output 0 as a determination flag Fj when the sign of the operation distance Da is positive and may output 1 as the determination flag Fj when the sign of the operation distance Da is negative. In this case, the determination flag Fj=0 is the first information and the determination flag Fj=1 is the second information.

In the present embodiment, the right manipulation lever 30R and the left manipulation lever 30L of the manipulation device 30 may be a pilot pressure-type manipulation lever. Moreover, the right manipulation lever 30R and the left manipulation lever 30L may be an electromagnetic lever-type manipulation lever which outputs an electrical signal based on these operation amounts (tilting angles) to the control device 50 and controls the flow rate control valve 25 directly based on the control signal of the control device 50.

While the present embodiment has been described, the present embodiment is not limited to the contents described above. Moreover, the above-described constituent elements include those easily conceivable by a person of ordinary skill in the art, those substantially the same as the constituent elements, and those falling in the range of so-called equivalents. Further, the above-described constituent elements can be appropriately combined with each other. Furthermore, various omissions, substitutions, or changes in the constituent elements can be made without departing from the spirit of the embodiment.

REFERENCE SIGNS LIST

1 WORKING DEVICE
2 UPPER SWINGING BODY
3 LOWER TRAVELING BODY
6 BOOM
7 ARM
8 BUCKET
8T TILTING PIN
8C BLADE
8TF FIRST END
8TS SECOND END
9 TIP
10 HYDRAULIC CYLINDER
14 TILTING CYLINDER
20 POSITION DETECTION DEVICE
21 VEHICLE BODY POSITION CALCULATOR
22 POSTURE CALCULATOR
23 ORIENTATION CALCULATOR
24 WORKING DEVICE ANGLE DETECTION DEVICE
25 FLOW RATE CONTROL VALVE
30 MANIPULATION DEVICE
30T TILTING MANIPULATION LEVER
50 CONTROL DEVICE
51 PROCESSING UNIT
51A VEHICLE BODY POSITION DATA ACQUISITION UNIT
51B WORKING DEVICE ANGLE DATA ACQUISITION UNIT
51Ca CANDIDATE REGULATION POINT POSITION DATA CALCULATION UNIT
51D TARGET CONSTRUCTION SHAPE GENERATION UNIT
51Cb REGULATION POINT POSITION DATA CALCULATION UNIT
51E OPERATION PLANE CALCULATION UNIT
51F STOP GROUND SHAPE CALCULATION UNIT
51G WORKING DEVICE CONTROL UNIT
51H RESTRICTION SPEED DETERMINATION UNIT
51J DETERMINATION UNIT
52 STORAGE UNIT
53 INPUT/OUTPUT UNIT
70 TARGET CONSTRUCTION DATA GENERATION DEVICE
100 EXCAVATOR
200 CONTROL SYSTEM

300 HYDRAULIC SYSTEM
400 DETECTION SYSTEM
AS AIR SIDE
AX4 TILTING SHAFT
CD TARGET CONSTRUCTION DATA
CS TARGET CONSTRUCTION SHAPE
Da OPERATION DISTANCE
SS GROUND SIDE
TP TILTING OPERATION PLANE

The invention claimed is:

1. A work machine control system that controls a work machine including a first member that rotates about a shaft of a first direction and a second member that rotates about a shaft of a second direction different from the first direction, comprising:

a determination unit that determines whether a member is present on an air side which is a side on which the work machine is present in relation to a target construction shape indicating a shape of a construction target of the work machine based on a positional relation between the second shaft and the target construction shape and outputs first information when the second member is present on the air side in relation to the target construction shape and outputs second information when the second member is present on a ground side which is a side that is opposite the air side in relation to the target construction shape.

2. The work machine control system according to claim 1, further comprising:

a working device control unit that allows rotation of the second member when the first information is output from the determination unit and does not allow rotation of the second member when the second information is output.

3. The work machine control system according to claim 1, further comprising:

a target construction shape generation unit that generates the target construction shape indicating the target shape of the construction target of the work machine, wherein the target construction shape generation unit generates a plurality of the target construction shapes around the second member, and the determination unit outputs the first information or the second information with respect to the plurality of target construction shapes.

4. A work machine control system that controls a work machine including a member that rotates about a shaft line, comprising:

a determination unit that outputs first information when the member is present on an air side which is a side on which the work machine is present in relation to a target construction shape indicating a shape of a construction target of the work machine and outputs second information when the member is present on a ground side which is a side that is opposite the air side in relation to the target construction shape;

a candidate regulation point position data calculation unit that calculates position data of a regulation point set to the member;

an operation plane calculation unit that calculates an operation plane which passes through the regulation point and is orthogonal to the shaft line; and a stop ground shape calculation unit that calculates a stop ground shape in which the target construction shape and the operation plane cross each other, wherein the determination unit outputs the first information or the second information using a distance between the stop ground shape and the regulation point, a first vector extending in a direction orthogonal to the target construction shape, and a second vector extending in an extension direction of the shaft line.

5. A work machine control system that controls a work machine including a member that rotates about a shaft line, comprising:

a determination unit that outputs first information when the member is present on an air side which is a side on which the work machine is present in relation to a target construction shape indicating a shape of a construction target of the work machine and outputs second information when the member is present on a ground side which is a side that is opposite the air side in relation to the target construction shape;

a known reference point which is located at a position of a portion different from the member of the work machine; and a candidate regulation point position data calculation unit that calculates position data of a regulation point set to the member, wherein the determination unit calculates the number of intersections between the target construction shape and a line segment that connects the reference point and the regulation point and outputs the first information or the second information using whether the number is an even number or an odd number.

6. A work machine comprising:

an upper swinging body;

a lower traveling body that supports the upper swinging body;

a working device which includes a boom that rotates about a first shaft, an arm that rotates about a second shaft, and a bucket that rotates about a third shaft, the working device being supported on the upper swinging body; and a work machine control system according to claim 1, wherein the shaft of the first direction is one of the first shaft, the second shaft and the third shaft, the first member is one of the boom and the arm, the second member is the bucket, and the bucket rotates about a tilting shaft which is the shaft of the second direction.

7. The work machine according to claim 6, wherein the first shaft and the second shaft are orthogonal to the third shaft.

8. A work machine control method of controlling a work machine including a first member that rotates about a shaft of a first direction and a second member that rotates about a shaft of a second direction different from the first direction, comprising:

determining whether a member is present on an air side which is a side on which the work machine is present in relation to a target construction shape indicating a shape of a construction target of the work machine based on a positional relation between the second shaft and the target construction shape;

outputting first information when the second member is present on the air side in relation to the target construction shape; and outputting second information when the second member is present on a ground side which is a side that is opposite the air side in relation to the target construction shape.

* * * * *